US008281964B2

(12) United States Patent
Schmeisser

(10) Patent No.: US 8,281,964 B2
(45) Date of Patent: Oct. 9, 2012

(54) ROTARY STIRRING DEVICE FOR TREATING MOLTEN METAL

(75) Inventor: Dirk Schmeisser, Velen (DE)

(73) Assignee: Foseco International Limited, Derbyshire (GB)

( * ) Notice: Subject to any disclaimer, the term of this patent is extended or adjusted under 35 U.S.C. 154(b) by 277 days.

(21) Appl. No.: 12/452,222

(22) PCT Filed: Jun. 13, 2008

(86) PCT No.: PCT/GB2008/002022

§ 371 (c)(1), (2), (4) Date: Jan. 12, 2010

(87) PCT Pub. No.: WO2009/004283

PCT Pub. Date: Jan. 8, 2009

(65) Prior Publication Data

US 2010/0101371 A1 Apr. 29, 2010

(30) Foreign Application Priority Data

Jul. 5, 2007 (GB) ..... 07252705.4

(51) Int. Cl.
*C22B 26/22* (2006.01)

(52) U.S. Cl. ..... 222/590; 222/603; 222/594

(58) Field of Classification Search ..... 222/603, 222/594, 591, 590
See application file for complete search history.

(56) References Cited

U.S. PATENT DOCUMENTS

| | | | | |
|---|---|---|---|---|
| 5,160,693 | A | 11/1992 | Eckert et al. | |
| 5,364,078 | A | 11/1994 | Pelton | |
| 6,056,803 | A | 5/2000 | Waite | |
| 7,669,739 | B2 * | 3/2010 | Schmeisser | 222/603 |
| 2006/0180962 | A1 | 8/2006 | Thut | |

FOREIGN PATENT DOCUMENTS

| | | |
|---|---|---|
| DE | 103 01 561 A1 | 5/2004 |
| EP | 1 573 077 B1 | 8/2006 |
| GB | 1 578 570 | 11/1980 |

OTHER PUBLICATIONS

Co-pending U.S. Appl. No. 29/304,264, filed Feb. 27, 2008.
Co-pending U.S. Appl. No. 29/304,265, filed Feb. 27, 2008.
Co-pending U.S. Appl. No. 29/304,266, filed Feb. 27, 2008.

* cited by examiner

*Primary Examiner* — Scott Kastler
(74) *Attorney, Agent, or Firm* — Nixon & Vanderhye

(57) ABSTRACT

Rotary device for treating molten metal has a hollow shaft with a rotor having a roof and a base spaced apart and connected by a plurality of dividers. A passage extends between each adjacent pair of dividers and the roof and the base. A flow path extends through the shaft into inlets of the passages and out of outlets. A chamber in which mixing of the molten metal and gas can take place is located radially inwardly of the inlets, has an opening in the base of the rotor and is in the flowpath between the shaft and the inlets. Upon rotation of the device, molten metal is drawn into the chamber through the rotor base where it is mixed with gas passing into the chamber from the shaft. The metal/gas dispersion is pumped into the passages through the inlets before discharge from the rotor through the outlets.

24 Claims, 22 Drawing Sheets

ROTARY STIRRING DEVICE FOR TREATING MOLTEN METAL

This application is the U.S. national phase of International Application No. PCT/GB2008/002022 filed 13 Jun. 2008 which designated the U.S. and claims priority to European Application No. 07252705.4 filed 5 Jul. 2007, the entire contents of each of which are hereby incorporated by reference.

BACKGROUND OF THE INVENTION

The present invention relates to a rotary stirring device for treating a molten metal and to metal treatment equipment comprising such a device.

It is well known that molten metal, in particular non-ferrous molten metals such as aluminium alloys, must be treated before casting, typically by one or more of the following processes in order to:

i) Degas—The presence of dissolved gas in molten metal can introduce defects in the solidified product and may reduce its mechanical properties. For example, defects are introduced in castings and wrought products manufactured from aluminium or its alloys. Hydrogen has a high solubility in liquid aluminium which increases with melt temperature, but the solubility in solid aluminium is very low, so that as the aluminium solidifies, hydrogen gas is expelled causing gas pores in the casting. The rate of solidification influences the amount and size of the bubbles and in certain applications the pinhole porosity may seriously affect the mechanical strength and the pressure tightness of the metal casting. Gas may also diffuse into voids and discontinuities (e.g. oxide inclusions) which can result in blister formation during the production of aluminium alloy plate, sheet and strip.

ii) Grain refine—Mechanical properties of the casting can be improved by controlling the grain size of the solidifying metal. The grain size of a cast alloy is dependent on the number of nuclei present in the liquid metal as it begins to solidify and on the rate of cooling. A faster cooling rate generally promotes a smaller grain size and additions of certain elements to the melt can provide nuclei for grain growth.

iii) Modify—The microstructure and properties of alloys can be improved by the addition of small quantities of certain 'modifying' elements such as sodium or strontium. Modification increases hot tear resistance and improves alloy feeding characteristics, decreasing shrinkage porosity.

iv) Cleaning and Alkali Removal—Certain levels of alkali elements may have adverse effects on alloy properties and therefore they need to be removed/reduced. The presence of calcium in casting alloys interferes with other processes such as modification, whereas sodium has a deleterious effect on the ductile properties of wrought aluminium alloys. The presence of non metallic inclusions such as oxides, carbides and borides entrained in the solidified metal adversely affects the physical and mechanical properties of the metal, and they therefore need to be removed.

These actions may be carried out individually or together by a variety of methods and equipment. One approach for adding metal treatment substances is to add them directly to the molten metal as powder, granules or encapsulated in a (aluminium or copper) metal can, whilst mechanically stirring the molten metal to ensure effective distribution throughout the melt. Particulate metal treatment agents may also be introduced by the use of a lance with an open discharge placed below the surface of the molten metal. Powdered or granulated additives are then injected down the lance under pressure using a carrier gas. The lance is typically a hollow tube of graphite or silicon carbide with a thin walled steel insert tube through which the additives and gas are passed.

Degassing of molten metal is typically conducted using a rotary degassing unit ("RDU") by flushing the molten metal with fine bubbles of a dry inert gas such as chlorine, argon, nitrogen or a mixture thereof. Commonly this is carried out using a hollow shaft to which a rotor is attached. In use the shaft and rotor are rotated and gas is passed down the shaft and dispersed into the molten metal via the rotor. The use of a rotor rather than a lance is more efficient since it generates a large number of very fine bubbles at the base of the melt. These bubbles rise through the melt and hydrogen diffuses into them before being ejected into the atmosphere when the bubbles reach the surface. The rising bubbles also collect inclusions and carry them to the top of the melt where they can be skimmed off.

In addition to introducing gas to remove hydrogen (and oxide inclusions), the rotary degassing unit may also be used to inject metal treatment substances (also known as treatment agents) along with the gas via the shaft into the melt. This method of injection has similar drawbacks to that of lance injection, in that the metal treatment substances are prone to partial melting in the shaft causing blockages, particularly when using powdered material. The introduction and use of granular fluxes alleviated many of the difficulties, as did changes in equipment design.

One such example of equipment for both degassing and metal treatment is the Metal Treatment Station (MTS) developed and sold under the same trade name by Foseco. The first ("MTS") unit included an accurate dosing unit to allow treatment substances to be added via the shaft and then distributed via the rotor throughout the melt.

As an alternative to using the shaft to introduce the metal treatment agents, later equipment (the "MTS 1500" unit sold by Foseco) adds the treatment substances directly to the melt surface rather than via the shaft and rotor. In the MTS 1500, rotation of the rotor and shaft, within certain parameters, is used to form a vortex around the shaft. The metal treatment agents are then added into the vortex and readily dispersed throughout the melt. Any turbulence in the melt will lead to the introduction of air, and subsequently lead to the formation of oxides in the metal. Therefore the vortex is only employed for a short part of the treatment cycle and once the mixing stage is complete, it is stopped (e.g. by application of a baffle plate). An efficient rotor will create a vortex and disperse the treatments agents as quickly as possible in order to keep the turbulence in the melt to a minimum. Degassing and removal of the reaction products from the melt is then carried out. The intense mixing action of the initial vortex followed by the quiescent part of the cycle (e.g. after the baffle plate has been lowered) leads to efficient use of the treatment agents and optimum melt quality.

An example of a rotary device for use in a rotary degassing unit either with or without an additional process stage such as in a Metal Treatment Station is the "XSR rotor" (prior art rotor 1) described in WO2004/057045 (the entirety of which disclosure is included herein by reference) and shown in FIG. 1. The rotary device 2 comprises a shaft 4 having a bore 4*a* therethrough connected at one end to a rotor 6 via a tubular connection piece (not shown). The rotor 6 is generally disc-shaped and comprises an annular upper part (roof 8) and spaced therefrom an annular lower part (base 10). An open chamber 12 is provided centrally in the base 10 and extends upwardly to the roof 8. The roof 8 and base 10 are connected by four dividers 14 which extend outwardly from the periphery of the chamber 12 to the periphery of the rotor 6. A compartment 16 is defined between each pair of adjacent dividers 14, the roof 8 and the base 10. The peripheral edge 8*a* of the roof 8 is provided with a plurality (eight in this embodiment) of part-circular cut-outs 18. Each cut-out 18 serves as a second outlet for its respective compartment 16.

A further prior art rotor is the rotor sold primarily for degassing only by Vesuvius under the trade name Diaman™ (prior art rotor 2) and shown in plan view in FIG. 2. It is generally disc-shaped and comprises four radial bores 22 equiangularly spaced around the rotor 20. Each bore 22 extends from the inner surface of the rotor 20 to its peripheral surface 20*a* thereby providing an outlet 24 for the gas. The rotor has four cut-outs 26 that extend inwardly from the peripheral surface 20*a* of the rotor. Each cut-out 26 is located at an outlet 24 and extends downwardly for the entire depth of the rotor 20. There is no chamber for the mixing of gas and molten metal. In use the rotor is attached to a hollow shaft (not shown).

U.S. Pat. No. 6,056,803 discloses an injector for injecting gas into molten metal. The injector consists of a smooth faced rotor attached to the bottom end of a cylindrical shaft. The rotor is in the form of an upright lower cylindrical portion and an upper conical portion. The lower cylindrical portion is provided with a centrally-located cavity from which several passages extend radially. Gas passageways introduce gas into the passages but lack direct communication with the cavity.

DE 103 01 561 discloses a rotor head having a truncated cone shape with a central bore. The side of the rotor head is contoured by the presence of lateral grooves and the underside comprises radially extending channels.

U.S. Pat. No. 5,160,593 discloses a multiple-vaned impeller head that is adapted for mounting on a hollow impeller shaft and is used to treat molten metal. The impeller head has a hub with a central axial bore and a number of vanes are fixed to and extend beyond the hub. The vanes create turbulence for enhancing liquid and gas interphase interaction.

SUMMARY OF THE INVENTION

It is an object of the present invention to provide an improved rotary device and metal treatment equipment (for degassing and/or for addition of metal treatment agents) comprising such a device which preferably offers one or more of the following advantages over the known devices:

(i) metallurgical benefits such as more rapid degassing and/or more rapid and/or effective mixing of treatment agents;

(ii) economic benefits such as higher durability and life of equipment, reduced treatment costs and reduced waste;

(iii) health and safety benefits such as reduced contact between treatment substances and the atmosphere leading to reduced gaseous particulate emissions;

(iv) environmental benefits e.g. through a reduction in the quantity of treatment substances required, lower energy consumption due to reduced treatment times and reduced waste.

According to the present invention there is provided a rotary device for treating molten metal, said device comprising a hollow shaft at one end of which is a rotor, said rotor having:— a roof and a base, said roof and base being spaced apart and connected by a plurality of dividers;

a passage being defined between each adjacent pair of dividers and the roof and base, each passage having an inlet in an inner surface of the rotor and an outlet in a peripheral surface of the rotor, each outlet having a greater cross-sectional area than the respective inlet and being disposed radially outward therefrom;

a flow path being defined through the shaft into the inlets of the passages and out of the outlets; and a chamber in which mixing of the molten metal and gas can take place;

wherein a plurality of first cut-outs are provided in the roof and a plurality of second cut outs are provided in the base, each of the first and second cut outs being contiguous with one of the passages.

Surprisingly, the inventors have found that the combination of a chamber, outlets having a larger cross-section than the inlets and cut-outs in the roof and the base, results in both improved degassing and improved mixing of molten metal such that rotation speed can be reduced while maintaining the same efficiency of degassing/mixing, thereby extending the life of the shaft and rotor, or degassing/mixing times can be achieved more efficiently at the same rotor speed, providing an opportunity to reduce treatment time.

In one embodiment, the rotor is formed from a solid block of material, the roof and the base being constituted by upper and lower regions of the block respectively, an intermediate region of the block having bores/slots therein which define the passages, each divider being defined by the intermediate region between each bore/slot.

In one embodiment, each first cut-out (in the roof) extends inwardly from the outer peripheral surface of the rotor in which case each first cut-out will be contiguous with an outlet. In such an embodiment, the extent of each first cut-out in the peripheral surface is no more than, and possibly less than, that of the corresponding outlet. Conveniently, each first cut-out is part-circular. Conveniently, the first cut-outs are arranged symmetrically around the rotor. However, it will of course be appreciated that the first cut-outs can be of any shape and that one or more of the first cut-outs could alternatively be constituted by a bore (of any shape) through the roof into one of the passages.

The first cut-outs may be of the same or different size and/or shape. In one embodiment, however, all of the first cut-outs have the same size and shape.

In certain embodiments, each second cut-out (in the base) is a cut-out extending inwardly from the outer peripheral surface of the base. Conveniently, each second cut-out is part-circular. Conveniently, the second cut-outs are arranged symmetrically around the rotor. However, it will of course be appreciated that the second cut-outs can be of any shape and that one or more of the second cut-outs could alternatively be constituted by a bore (of any shape) through the base into one of the passages.

Each of the second cut-outs may have the same or different size and/or shape. In one embodiment, all of the second cut-outs have the same size and shape.

The second cut-outs may have the same size and/or shape as the first cut-outs or have a different size and/or shape. In one embodiment, all of the first and second cut-outs have the same size and shape.

The number of first cut-outs may be greater than, less than or equal to the number of second cut-outs. In one embodiment the number of first cut-outs is equal to the number of second cut-outs.

In certain embodiments, the rotor has three, four or five passages (defined by three, four or five dividers respectively). In a particular embodiment the rotor has four passages.

In certain embodiments, the rotor has at least one outlet and at least one each of the first and second cut-outs per passage. In particular embodiments, the rotor has one outlet, two first cut-outs and two second cut-outs per passage. In a yet further embodiment, the rotor has one outlet and one each of the first and second cut-outs per passage.

In one embodiment, each first cut-out in a passage is in at least partial register with a corresponding second cut-out. In a further embodiment, each first cut-out in a passage is in full register with a corresponding second cut-out (that is when viewed along the shaft axis towards the rotor, each first cut-out is directly above the corresponding second cut-out).

In one series of embodiments the first and/or second cut-outs extend inwardly no further than 50% or no further than 40% of the radius of the rotor. In some embodiments the first and/or second cut-outs extend inwardly no less than 10% or no less than 20% of the radius of the rotor. This is a particularly useful parameter when the cut-outs result in the portion (arc) of the peripheral surface of the rotor (roof or base) removed being straight, part-circular or arcuate in a plane orthogonal to the shaft axis. In one embodiment, the portion (arc) of the peripheral surface of the rotor (roof or base) removed is part-circular.

In a second series of embodiments in which the peripheral surface of the rotor in a plane orthogonal to the shaft axis is nominally a circle, the ratio of the length of the arc of the circle circumference removed in the roof by the first cut-out or cut-outs or removed in the base by the second cut-out or cut-outs contiguous with a given passage multiplied by the number of passages, to the circumference of the circle is at least 0.2, at least 0.3, at least 0.5 or at least 0.6. In a further embodiment, the ratio is no more than 0.9. It will therefore be understood that where there is more than one first or second cut-out contiguous with a given passage, the relevant ratio is the total length of arc of the circle circumference in the roof or base removed by all of the respective first or second cut-outs contiguous with a given passage multiplied by the number of passages, to the circumference of the circle.

The rotor is provided with a chamber in which mixing of molten metal and gas can take place. In one embodiment, the chamber is located radially inwardly of the inlets and has an opening in the base of the rotor and is in the flowpath between the shaft and the inlets, such that in use when the device rotates, molten metal is drawn into the chamber through the base of the rotor where it is mixed with gas passing into the chamber from the shaft, the metal/gas dispersion then being pumped into the passages through the inlets before being discharged from the rotor through the outlets.

In one embodiment, the shaft and rotor are formed separately, the two being attached together by releasable fixing means. The shaft may be connected directly to the rotor (e.g. by providing mating screw threads on each of the shaft and rotor), or indirectly, e.g. via a threaded tubular connection piece.

The rotor is conveniently formed from a solid block of material (such as graphite), the passages being conveniently formed by a milling operation. The rotor may also be produced by isostatically pressing or casting a suitable material (e.g. alumina-graphite) into the required shape (optionally machining a near-net shape to give the final dimensions) and then firing to produce the end product.

For the avoidance of doubt, it should be made clear that the invention resides also in the rotor per se and a metal treatment unit for degassing (RDU) and/or for addition of metal treatment substances (e.g. an MTS unit) comprising the rotary device of the invention.

The present invention further resides in a method of treating molten metal comprising the steps of:—

(i) immersing the rotor and part of the shaft of the device of the present invention in the molten metal to be treated, (ii) rotating the shaft, and (iii) passing gas and/or one or more treatment substances down the shaft and into the molten metal via the rotor and/or passing one or more treatment substances directly into the molten metal, whereby to treat the metal.

The nature of the molten metal is not restricted. However, suitable metals for the treatment include aluminium and its alloys (including low silicon alloys (4-6% Si) e.g. BS alloy LM4 (Al—Si5Cu3); medium silicon alloys (7.5-9.5% Si) e.g. BS alloy LM25 (Al—Si7Mg); eutectic alloys (10-13% Si) e.g. BS alloy LM6 (Al—Si12); hypereutectic alloys (>16% Si) e.g. BS alloy LM30 (Al—Sil7Cu4Mg); aluminium magnesium alloys e.g. BS alloy LM5 (Al—Mg5Sil; Al—Mg6)), magnesium and its alloys (e.g. BS alloy AZ91 (8.0-9.5% Al) and BS alloy AZ81 (7.5-9.0% Al)) and copper and its alloys (including high conductivity coppers, brasses, tin bronzes, phosphor bronzes, lead bronzes, gunmetals, aluminium bronzes and copper-nickels).

The gas may be an inert gas (such as argon or nitrogen) and is usually dry. Gases not traditionally regarded as being inert but having no deleterious effect on the metal may also be used such as chlorine, or a chlorinated hydrocarbon. The gas may be a mixture of two or more of the foregoing gases. From a balance between cost and inertness of the gas, dry nitrogen is most commonly used. The method is particularly useful for the removal of hydrogen gas from molten aluminium.

It will be understood that for any given rotor, efficiency of degassing will be determined by the speed of rotation, the gas flow rate and treatment time. A suitable rotation speed is 550 rpm or less, 400 rpm or less, or about 350 rpm.

When degassing is combined with the addition of treatment substances (also known as treatment agents), such treatment substances may be introduced into the melt before degassing, added during the initial degassing stage along with the inert purge gas, or added after the degassing stage. The treatment is then a combined degassing/grain refinement and/or modification and/or cleaning/drossing treatment. Whether used in conjunction with degassing or otherwise, the treatment substance may be cleaning/drossing, grain refining, modification species or a combination of these (often referred to as "flux" or "fluxes"). These fluxes can be in various physical forms (e.g. powder, granular, tablet, pellet etc.) and chemical type (e.g. inorganic salts, metal alloys etc.). Chemical fluxes include mixtures of alkali-metal and alkali-earth halides for cleaning and drossing. Other fluxes may be titanium and/or boron alloys (e.g. AlTiB alloy) for grain refining, and sodium salts or strontium (usually as 5-10% master alloy) for modification of aluminium-silicon alloys. Such processes are per se well known to the skilled foundryman.

The required size of the rotor, speed of rotation, gas flow rate and/or quantity of treatment substance will all be determined by the particular treatment being undertaken, taking into account the mass of metal being treated, the optimum treatment time and whether the process is a continuous or a batch process.

BRIEF DESCRIPTION OF THE DRAWINGS

Embodiments of the invention will now be described by way of example only with reference to the accompanying drawings in which:—

Example 1

Figure 1:
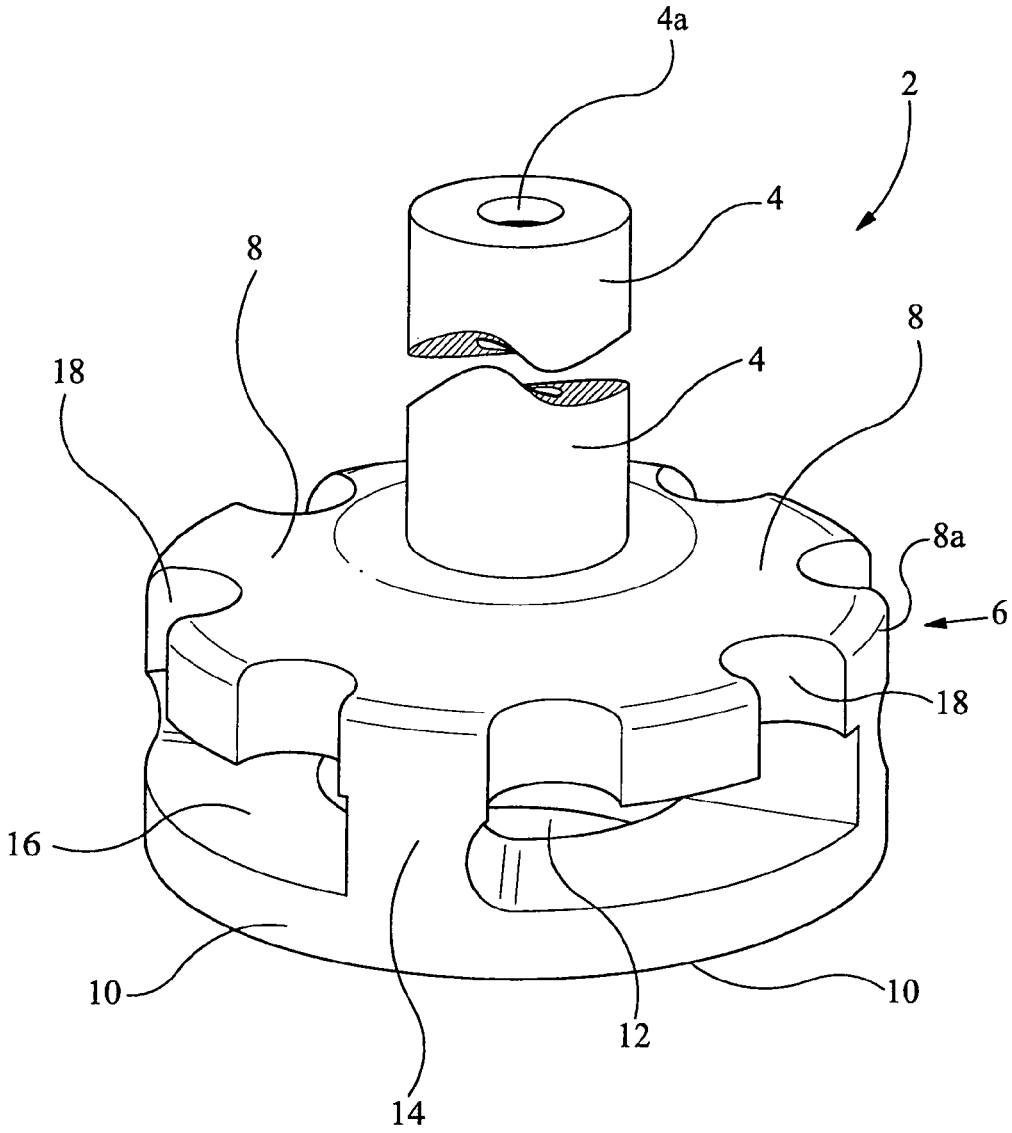
FIG. 1 shows an XSR (prior art) rotor.
Figure 2:
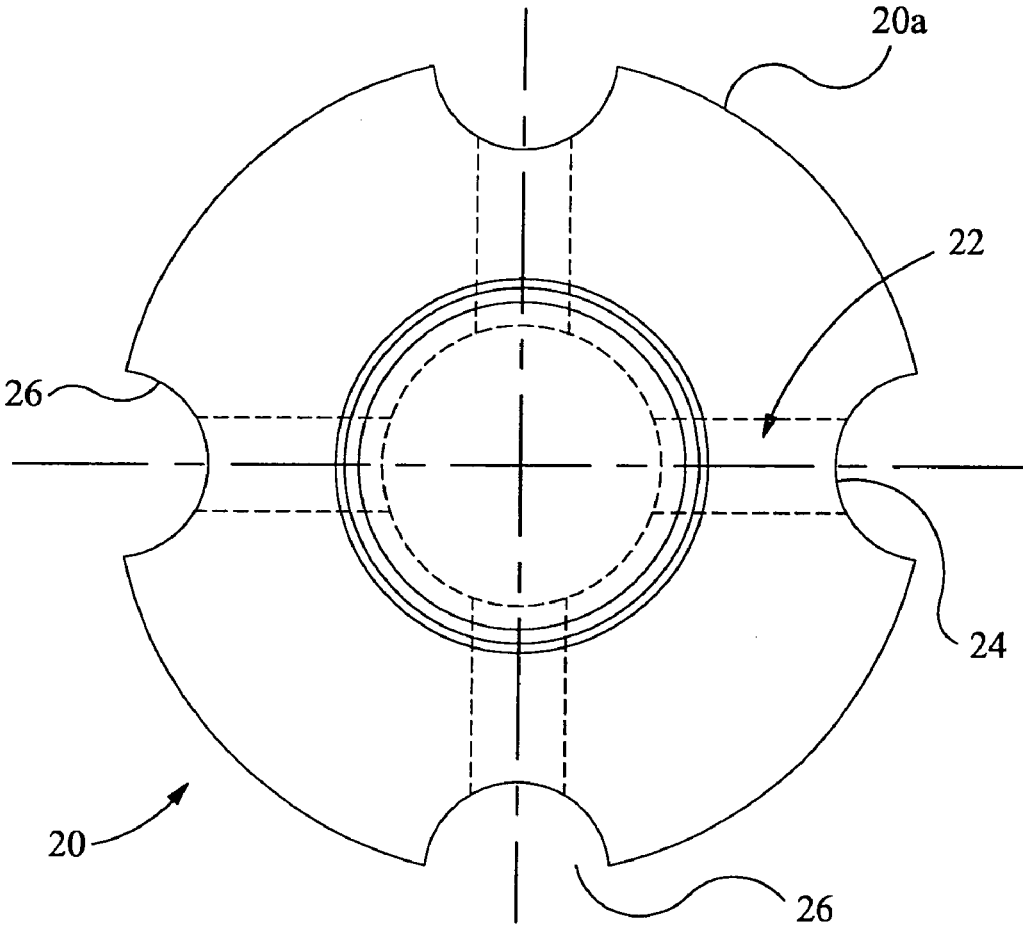
FIG. 2 shows a plan view of a DIAMANT™ (prior art) rotor.
Figure 3A:
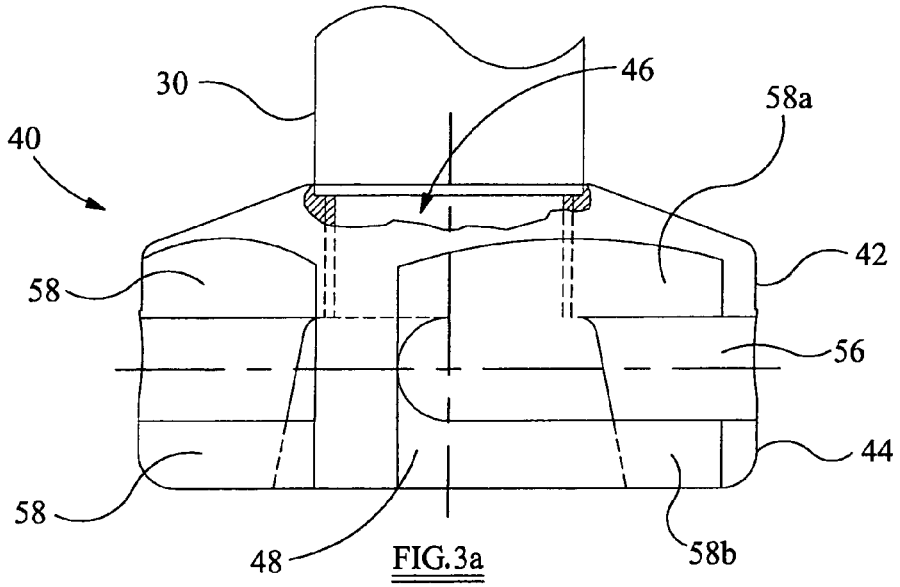
FIG. 3*a* shows a side view of a rotary device having a first rotor in accordance with the invention.

Referring to FIG. 3*a* a rotary device for dispersing gas and/or other treatment substances in molten metal in accordance with the invention is shown in plan view. The device comprises a shaft 30 and a rotor 40 releasably connected thereto. The rotor 40 is shown in plan view in FIG. 3*b*. The rotor 40 is made from graphite and is of unitary construction. The rotor 40 is generally disc-shaped and comprises an annular upper part (roof 42) and spaced therefrom an annular lower part (base 44). There is a threaded throughbore 46 in the roof 42 which attaches the rotor 40 to the shaft 30 via a threaded tubular connection piece (not shown). An open chamber 48 is provided centrally in the base 44 of the rotor 40. The chamber 48 extends upwardly to the roof 42, and is continuous with the throughbore 46 in the roof 42, the throughbore 46 and the chamber 48 thereby defining a continuous passage vertically through the rotor 40. The chamber 48 extends radially outwardly further than the throughbore 46. The roof 42 and base 44 are connected by dividers 50 which are equi-angularly spaced about the rotor 40 and disposed between the roof 42 and base 44. The dividers 50 extend outwardly from the periphery of the chamber 48 to the peripheral surface 40*a* of the rotor 40. A passage 52 is defined between each pair of adjacent dividers 50, the roof 42 and the base 44. Each passage 52 has an inlet 54 from the chamber 48 and an outlet 56 on the peripheral surface 40*a* of the rotor 40 in the form of an elongated slot. Each outlet 56 has a greater cross-sectional area than the corresponding inlet 54. The peripheral surfaces of the roof 42 and the base 44 are each provided with four part-circular cut-outs 58*a,b* (first and second cut-outs respectively). It will be clear that a continuous flow path exists from the source of the gas, through the bore of the shaft 30 and connection piece (not shown), through the roof 42 of the rotor 40 into the chamber 48, through the inlets 54 into the passages 52 and out of the rotor 40 through the outlet 56.

Figure 3B:
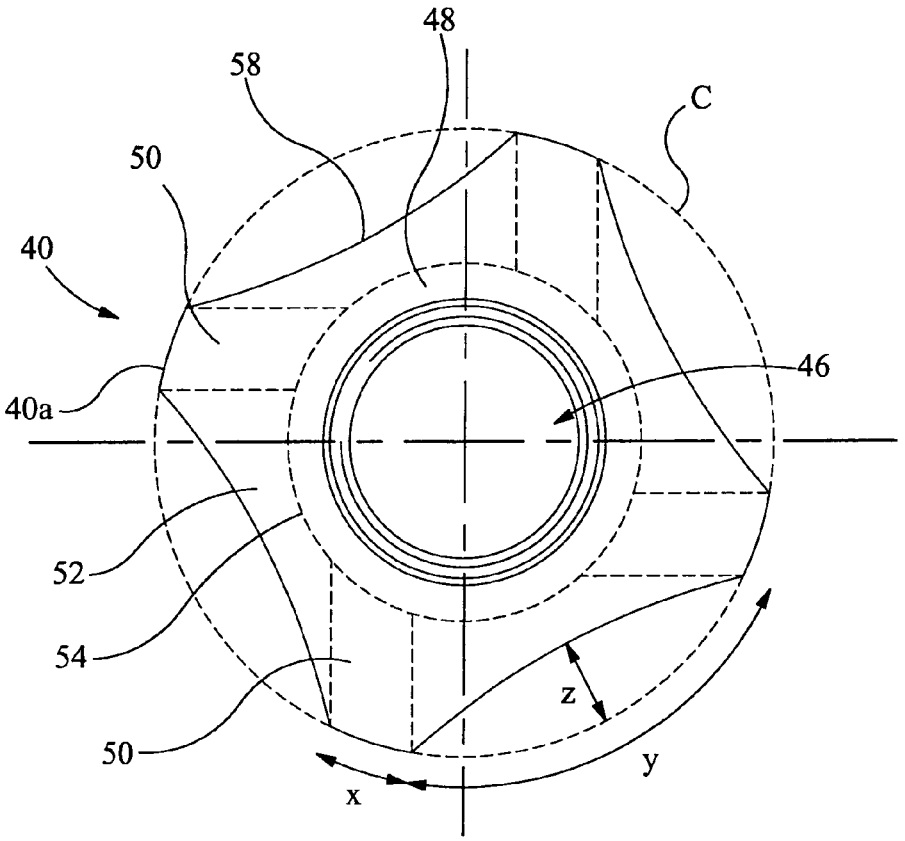
FIG. 3*b* shows a plan view of the rotor of FIG. 3*a*.
Figure 4A:
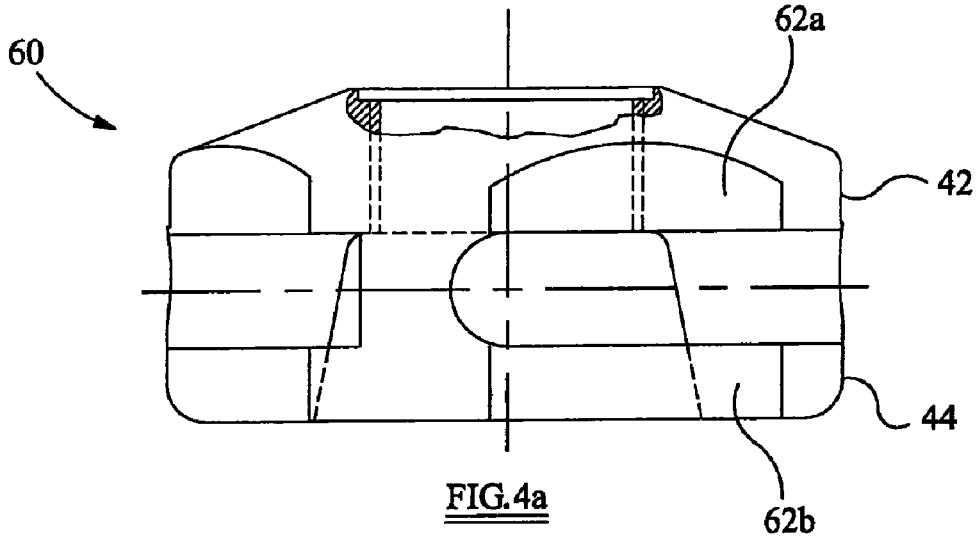
FIGS. 4*a* and 4*b* show a side and plan view respectively of a second rotor in accordance with the invention.
Figure 4B:
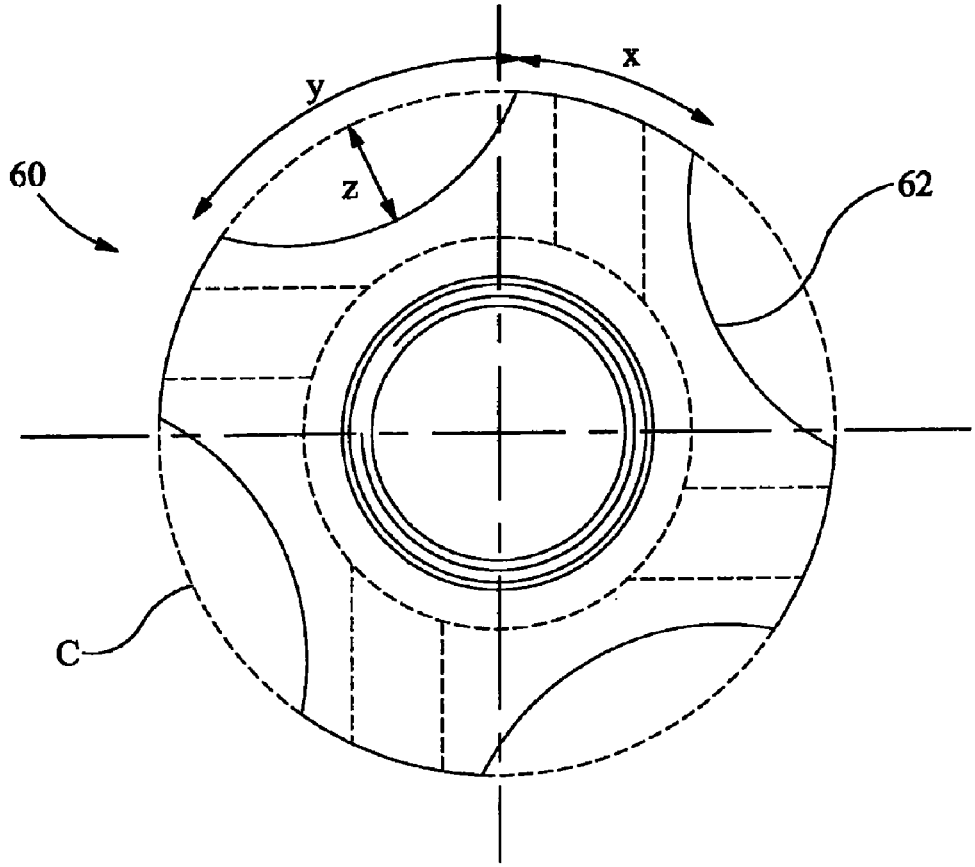
Figure 5A:
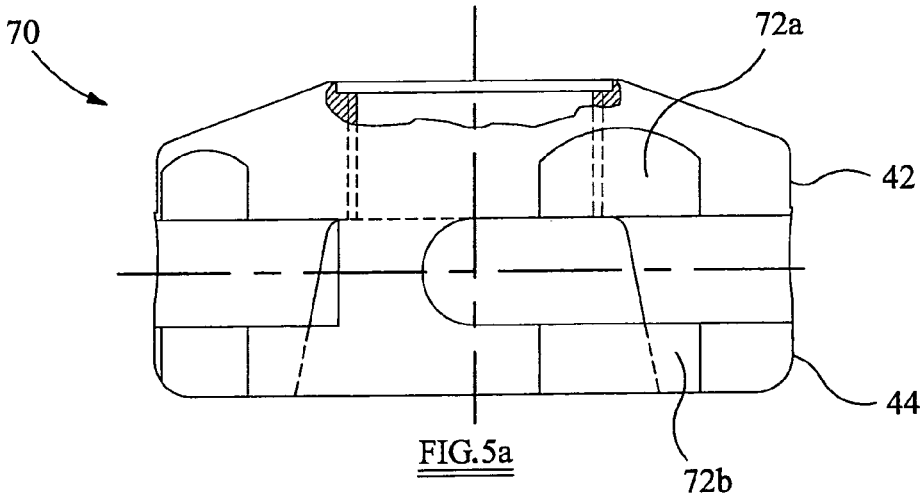
FIGS. 5*a* and 5*b* show a side and plan view respectively of a third rotor in accordance with the invention.
Figure 5B:
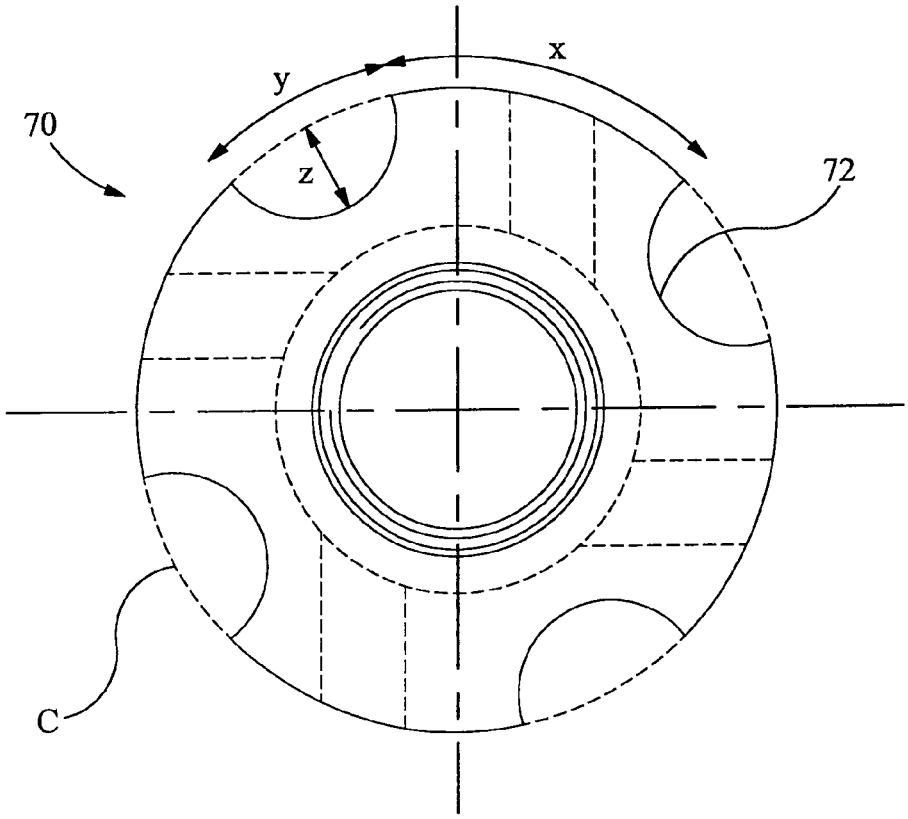
Figure 6A:
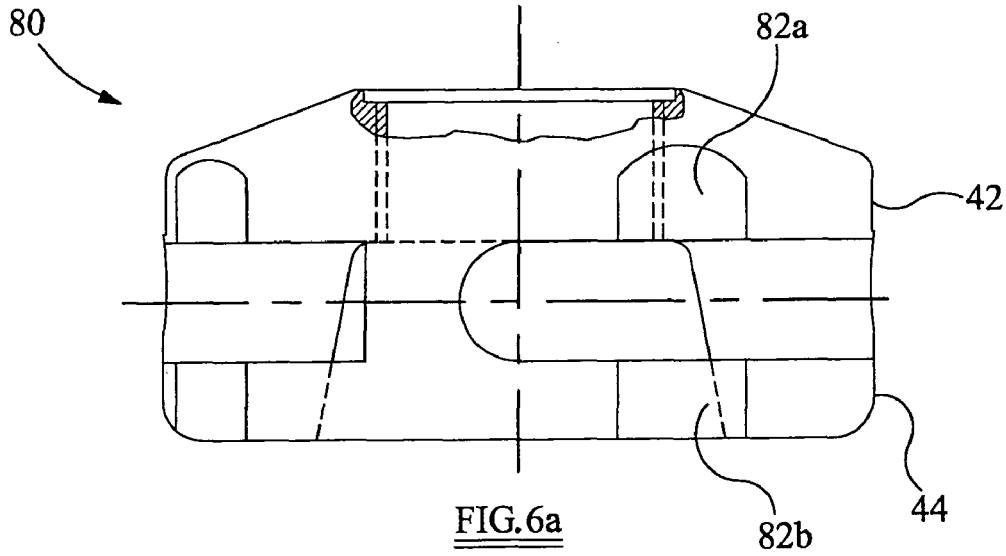
FIGS. 6*a* and 6*b* shows a side and plan view respectively of a fourth rotor in accordance with the invention.
Figure 6B:
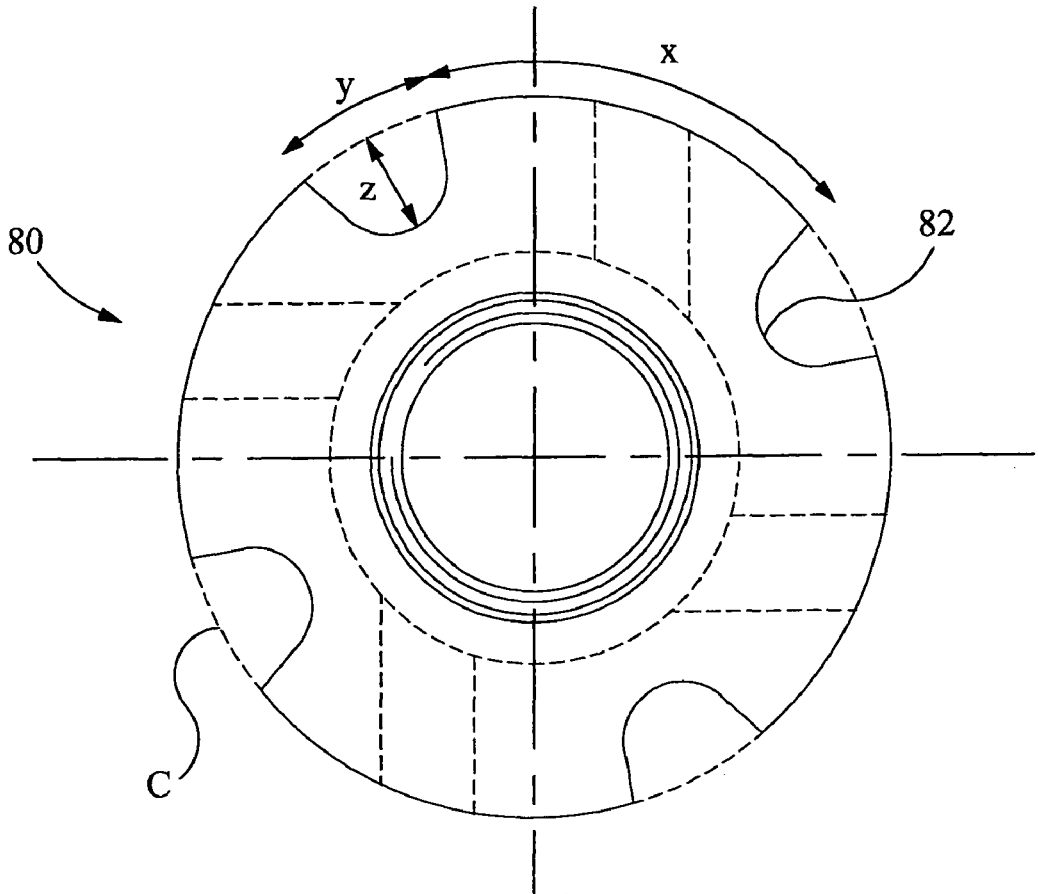
Figure 7A:
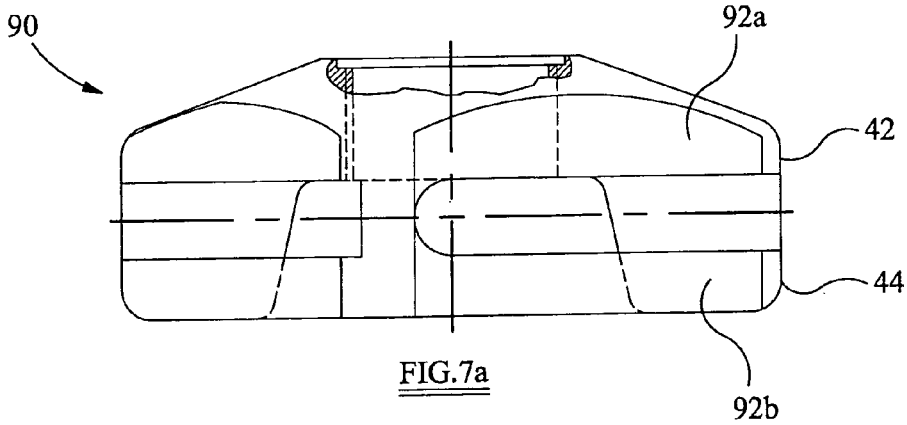
FIGS. 7*a* and 7*b* show a side and plan view respectively of a fifth rotor in accordance with the invention.
Figure 7B:
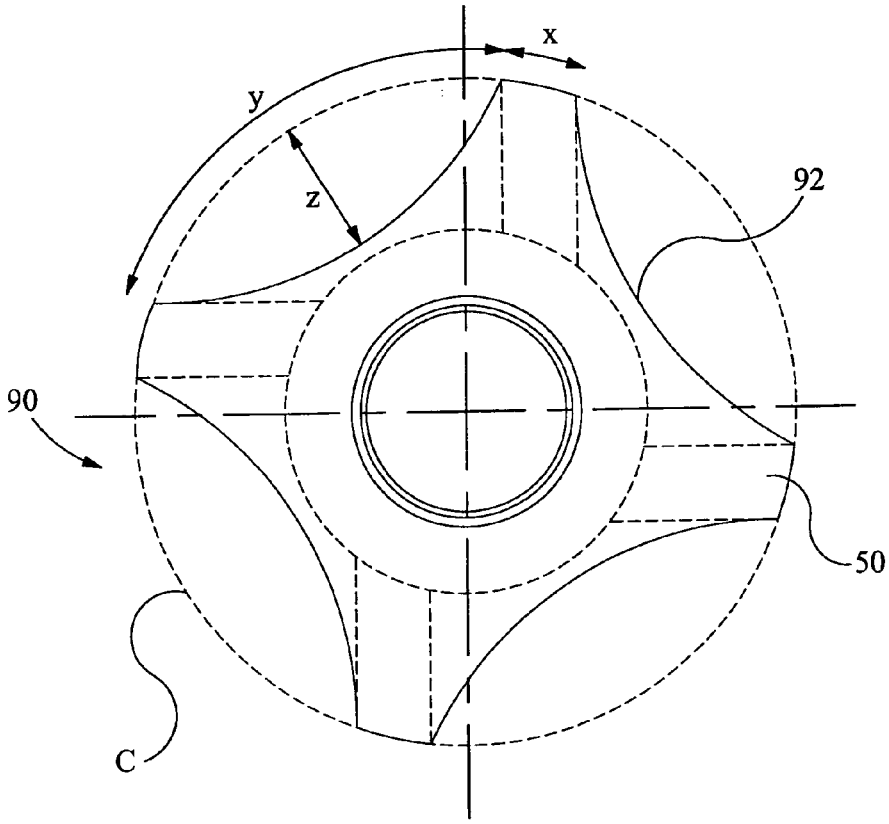
Figure 8A:
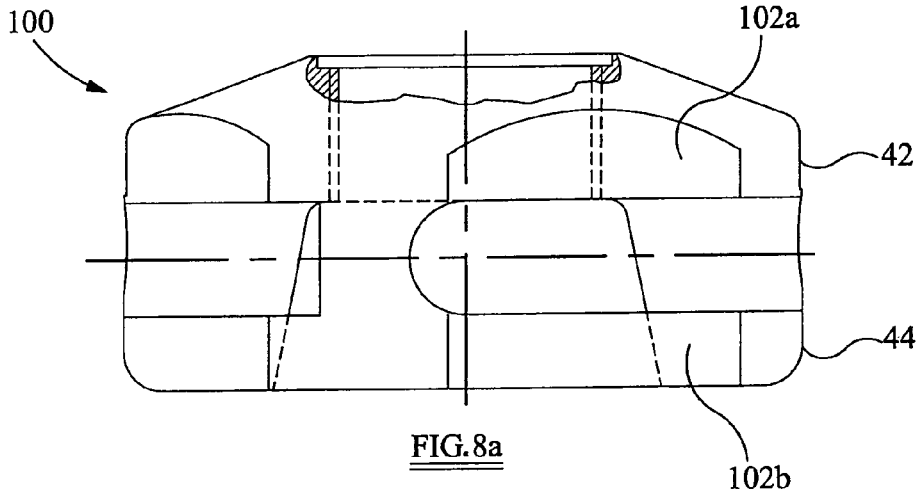
FIGS. 8*a* and 8*b* show a side and plan view respectively of sixth rotor in accordance with the invention.
Figure 8B:
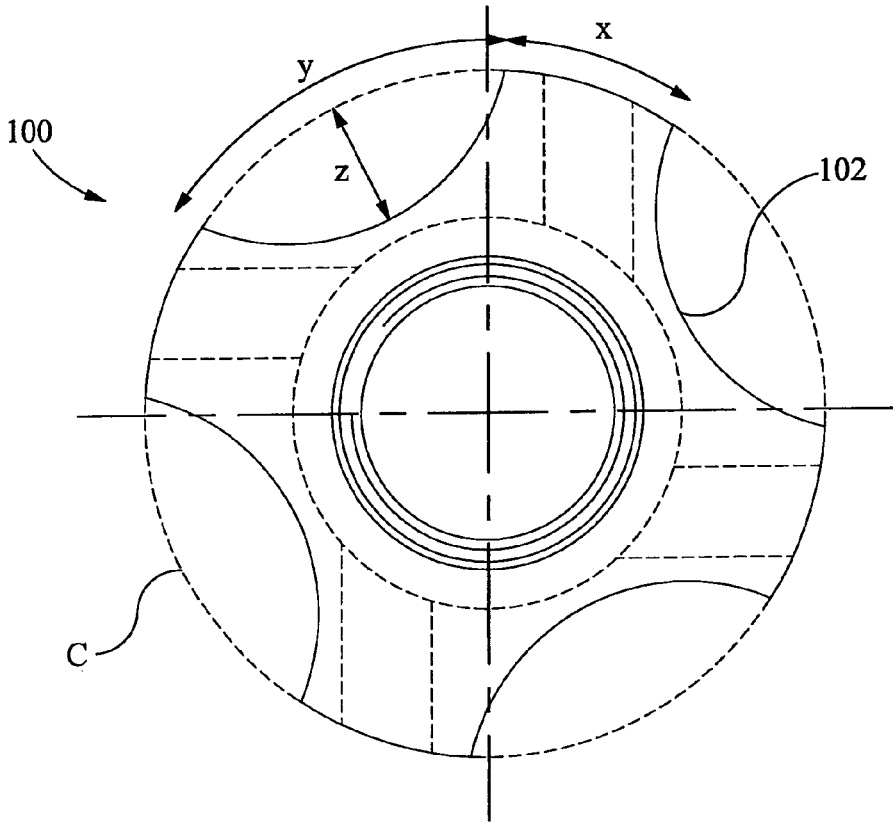

The cut-outs 58*a,b* in the roof 42 and the base 44 are in register i.e. when viewed in FIG. 3*b* they coincide. The rotor 40 is nominally circular (based on a circle C) in transverse cross-section (i.e. orthogonal to the shaft axis). Each of the cut-outs 58*a,b* extends inwardly a maximum distance z from the peripheral surfaces of the roof 42 and the base 44. When rotor 40 is based on a circle C having a radius (r) of 110 mm, z=32.45 mm. Therefore the cut-outs 58*a,b* extend inwardly for 29.5% of the radius of the rotor 40. Each of the cut-outs 58*a* in the roof extends the full distance between each pair of adjacent dividers 50 and removes an arc y of the circle C (referred to as the extent of the cut-out in the peripheral surface). The remaining portion of circle C between each pair of adjacent cut-outs 58*a* is labelled x. Since the rotor 40 has 4 cut-outs 58*a* in the roof 42 the total circumference of the circle C is 4(k+y).

Therefore the ratio of the length of the arc of the circle circumference removed by the first cut-outs contiguous with a given passage (y) multiplied by the number of passages (4), to the circumference of the circle (4(x+y)) is:

$$y/(x+y)$$

When rotor 40 is based on a circle C having a radius of 110 mm, x=24.96 mm and y=147.83 mm, and therefore y/(x+y) is 0.856. In this example the cut-outs in the roof and base are in register so the values derived above apply equally to the base and its cut-outs. It will be appreciated that in other embodiments x and y and hence y/(x+y) may be different for the base and roof.

Examples 2 to 6

Referring to FIGS. 4*a* to 8*a* and FIGS. 4*b* to 8*b* rotors 60 [Ex. 2], 70 [Ex. 3] and 80 [Ex. 4], 90 [Ex. 5] and 100 [Ex. 6] for dispersing gas and/or other treatment substances in molten metal are shown in side and plan view respectively. The rotors 60, 70, 80, 90 and 100 are identical to the rotor 40 except that the part-circular cut-outs 62*a,b*, 72*a,b*, 82*a,b*, 92*a,b* and 102*a,b* respectively which are disposed in the roof 42 and base 44 (designator "a" used for cut-outs in the roof and "b" for cut-outs in the base) are of a different size and shape for each of the rotors.

Each of the cut outs 58, 62, 72 and 82 in rotors 40, 60, 70 and 80 extend inwardly from the peripheral surfaces of the roof 42 and base 44 for a similar distance (similar z values) but they each remove a different length of arc (different y values) from the nominal circle C on which they are based. The length of arc (y) removed for each of the rotors decreases in the order 40, 60, 70 and 80.

Rotors 90 and 100 have part-circular cut-outs 92 and 102 respectively in the roof 42 and base 44. The cut-outs 92, 102 extend inwardly for a similar distance so the rotors 90 and 100 have similar z values but they remove different lengths of arc y from the circle C on which they are nominally based. The cut-outs 92 remove an arc y that extends the full distance between adjacent dividers 50 whereas the cut-outs 102 remove a shorter arc and consequently have a smaller y value.

Values of x, y, and z for rotors 40, 60, 70, 80, 90 100 with a radius of 110 mm are given in table 1 below.

TABLE 1

| | x (mm) | y (mm) | z (mm) | z/r (%) | y/(x + y) |
|---|---|---|---|---|---|
| Ex. 1 (rotor 40) | 24.96 | 147.83 | 32.45 | 29.5 | 0.856 |
| Ex. 2 (rotor 60) | 49.92 | 122.87 | 32.45 | 29.5 | 0.711 |
| Ex. 3 (rotor 70) | 107.50 | 65.28 | 32.77 | 29.8 | 0.378 |

TABLE 1-continued

| | x (mm) | y (mm) | z (mm) | z/r (%) | y/(x + y) |
|---|---|---|---|---|---|
| Ex. 4 (rotor 80) | 135.27 | 37.52 | 33.76 | 30.7 | 0.217 |
| Ex. 5 (rotor 90) | 24.96 | 147.83 | 42.17 | 38.3 | 0.856 |
| Ex. 6 (rotor 100) | 49.92 | 122.87 | 42.52 | 38.7 | 0.711 |

Example 7

Figure 9A:
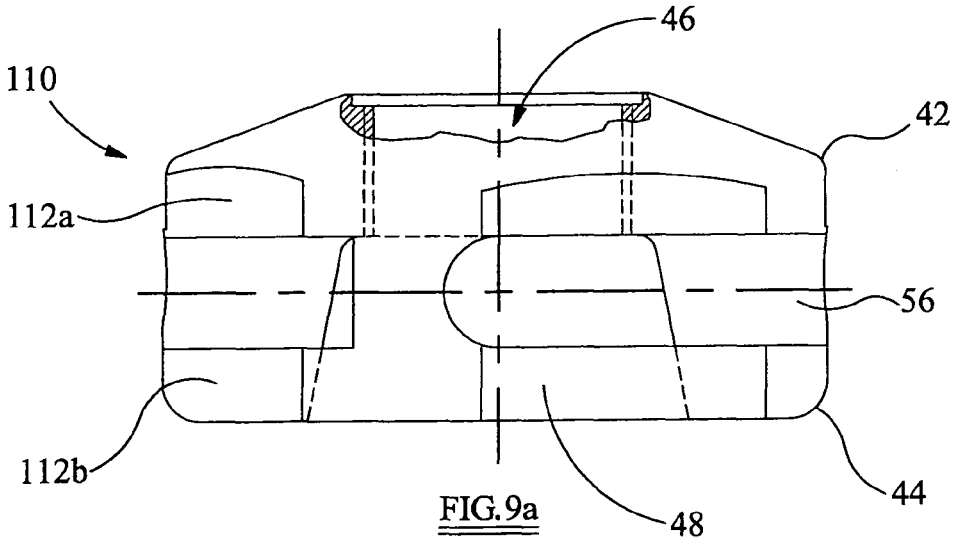
FIGS. 9*a* and 9*b* show a side and plan view respectively of seventh rotor in accordance with the invention.
Figure 9B:
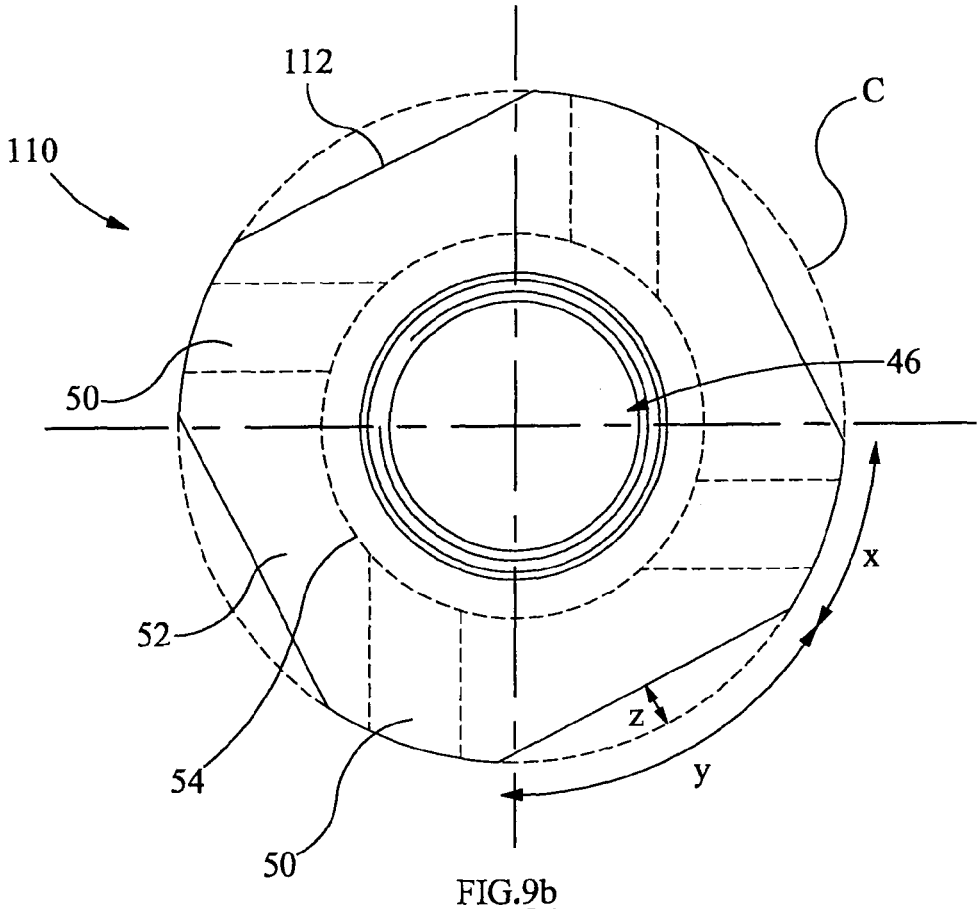

Referring to FIGS. 9*a* and 9*b*, a rotor 110 (Ex. 7) for dispersing gas and/or other treatment substances in molten metal is shown in side and plan view respectively. The rotor 110 is made from graphite and is of unitary construction. The rotor 110 is similar to rotor 40, having a roof 42, a base 44, a throughbore 46, a chamber 48, four dividers 50, four passages 52, four inlets 54 and four outlet slots 56, all as described previously. Rotor 110 has cut-outs 112*a,b* disposed in the roof 42 and the base respectively 44 and the cut-outs 112*a* in the roof and the cut-outs 112*b* in the base are in register (i.e. they coincide in plan view). The cut-outs 112 have a straight edge and so the rotor 110 when viewed from above has the appearance of a square with rounded edges, despite being nominally circular (based on circle C). The cut-outs 112 extend inwardly from the peripheral surfaces of the roof and base for a distance z and remove an arc y of circle C.

Example 8

Figure 10A:
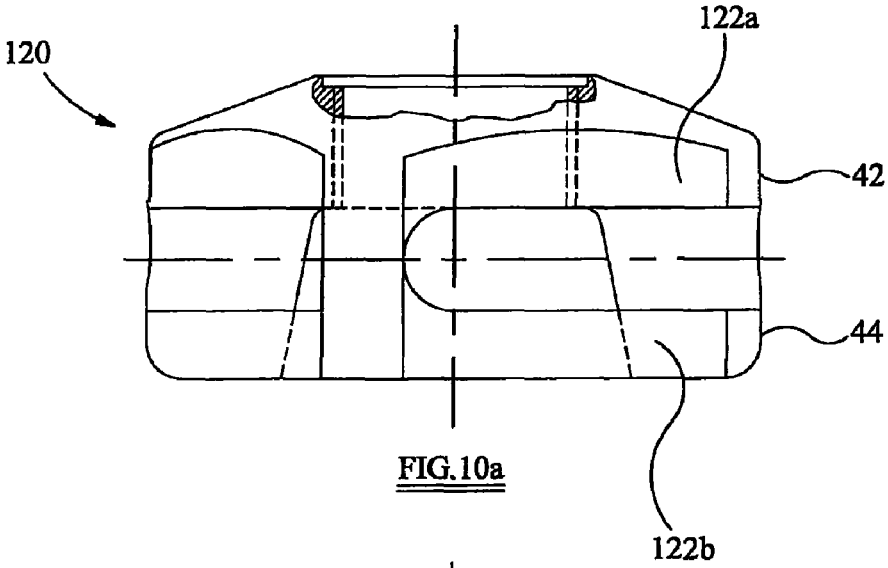
FIGS. 10*a* and 10*b* show a side and plan view respectively of an eighth rotor in accordance with the invention.
Figure 10B:
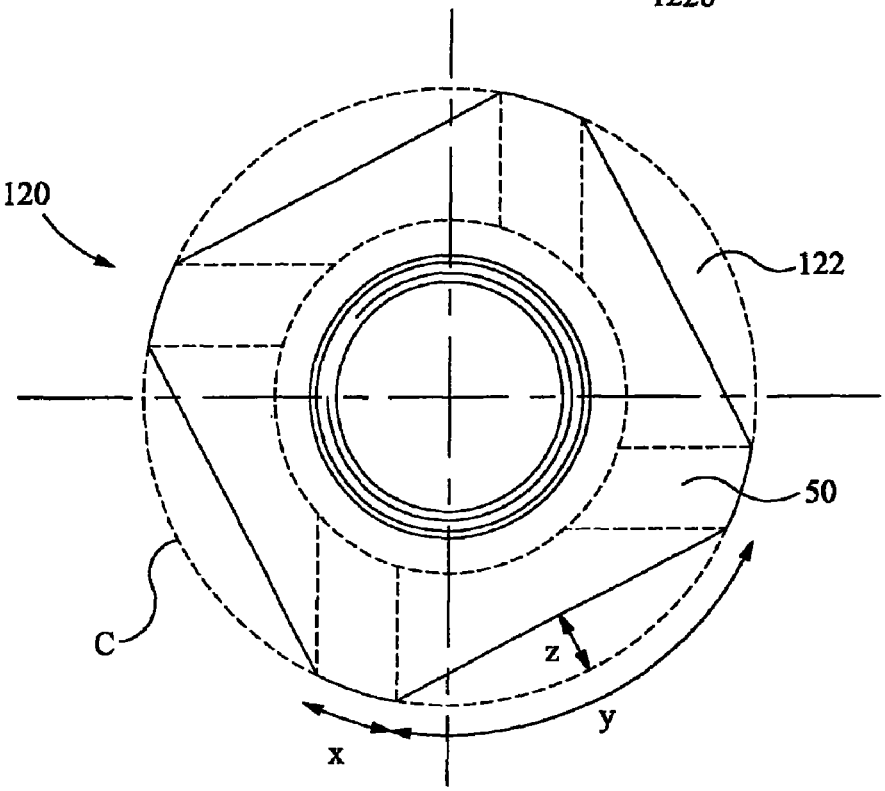

Referring to FIGS. 10*a* and 10*b*, a rotor 120 for dispersing gas and/or other treatment substances in molten metal is shown in side and plan view respectively. The rotor 120 is similar to rotor 110 and has straight cut-outs 122*a,b* so that it also has the appearance of a square with rounded edges when viewed from above. The cut-outs 122 extend for the full distance between adjacent dividers 50 and so rotor 120 has a larger y value than rotor 110. The cut-outs 122 extend inwardly from the peripheral surfaces of the roof 42 and base 44 respectively for a distance z.

Example 9

Figure 11A:
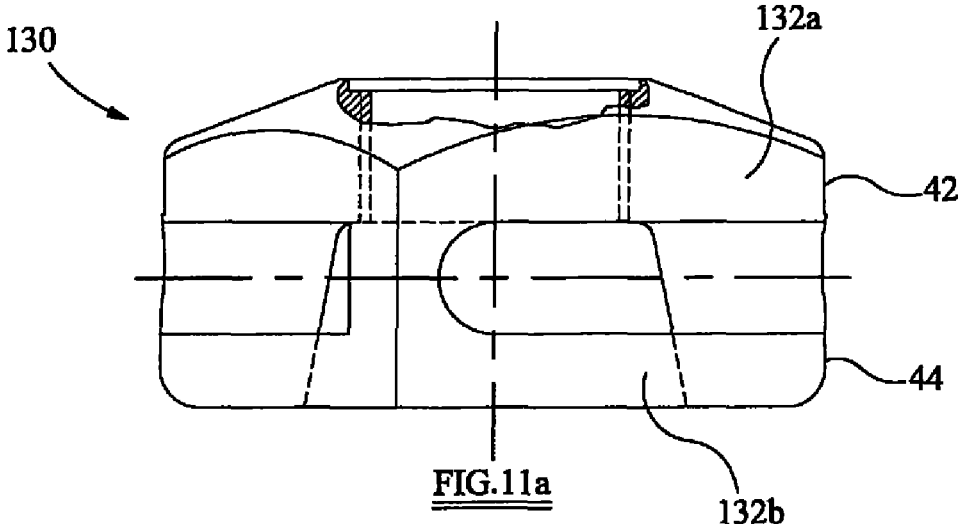
FIGS. 11*a* and 11*b* show a side and plan view respectively of a ninth rotor in accordance with the invention.
Figure 11B:
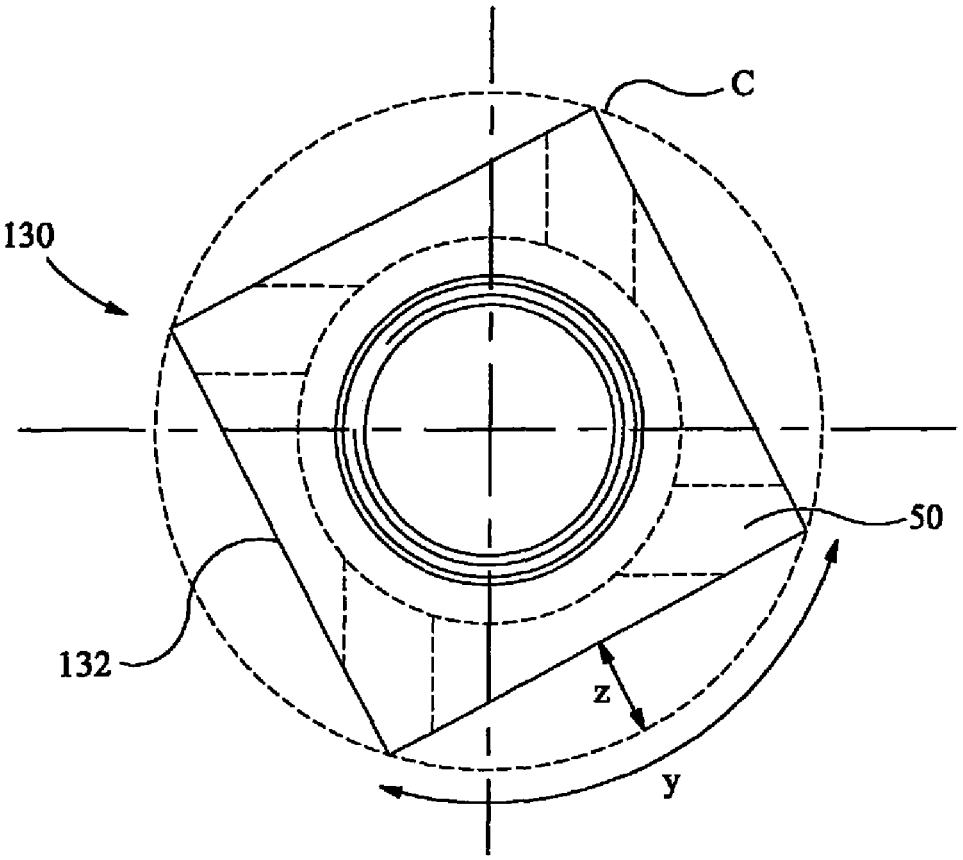

Referring to FIGS. 11*a* and 11*b*, a rotor 130 for dispersing gas and/or other treatment substances in molten metal is shown in side and plan view respectively. The rotor 130 is similar to rotors 110 and 120 and has cut-outs 132*a,b* which have straight edges. When viewed from above, the rotor 130 has a square shape because the cut-outs 132 extend into the dividers 50. Nevertheless, the rotor 130 can still be viewed as being nominally circular (based on circle C) in transverse cross-section. The cut-outs 132 extend inwardly from the peripheral surfaces of the roof 42 and base 44 for a distance z and because there is no distance between adjacent cut-outs 132 the x value is zero.

Values of x, y, and z for rotors 110, 120 and 130 with a radius of 110 mm are given in table 2 below.

TABLE 2

| | x (mm) | y (mm) | z (mm) | z/r (%) | y/(x + y) |
|---|---|---|---|---|---|
| Ex. 7 (rotor 110) | 49.92 | 122.87 | 16.81 | 15.3 | 0.711 |
| Ex. 8 (rotor 120) | 24.96 | 147.83 | 23.84 | 21.7 | 0.856 |
| Ex. 9 (rotor 130) | 0 | 172.79 | 32.22 | 29.3 | 1.000 |

Example 10

Figure 12A:
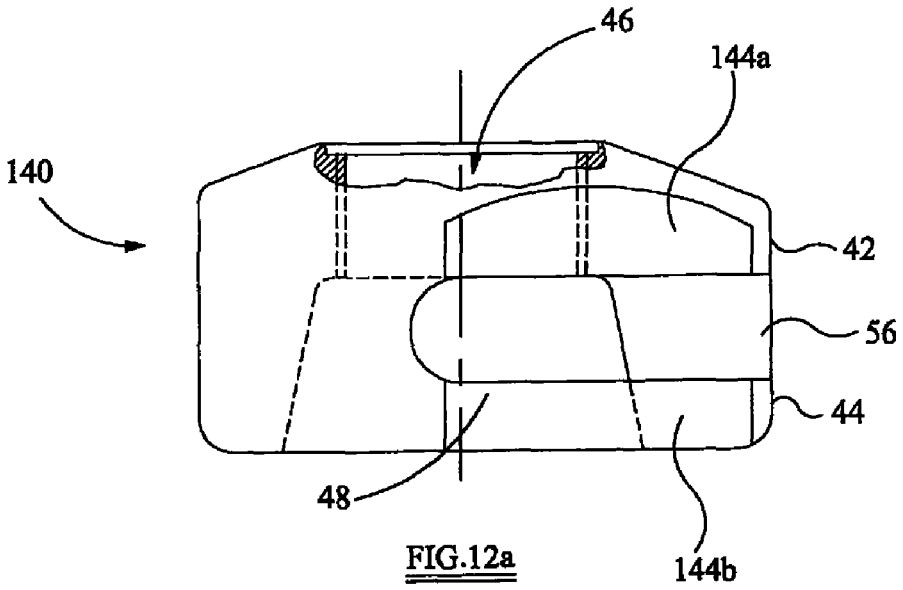
FIGS. 12*a* and 12*b* show a side and plan view respectively of a tenth rotor in accordance with the invention.
Figure 12B:
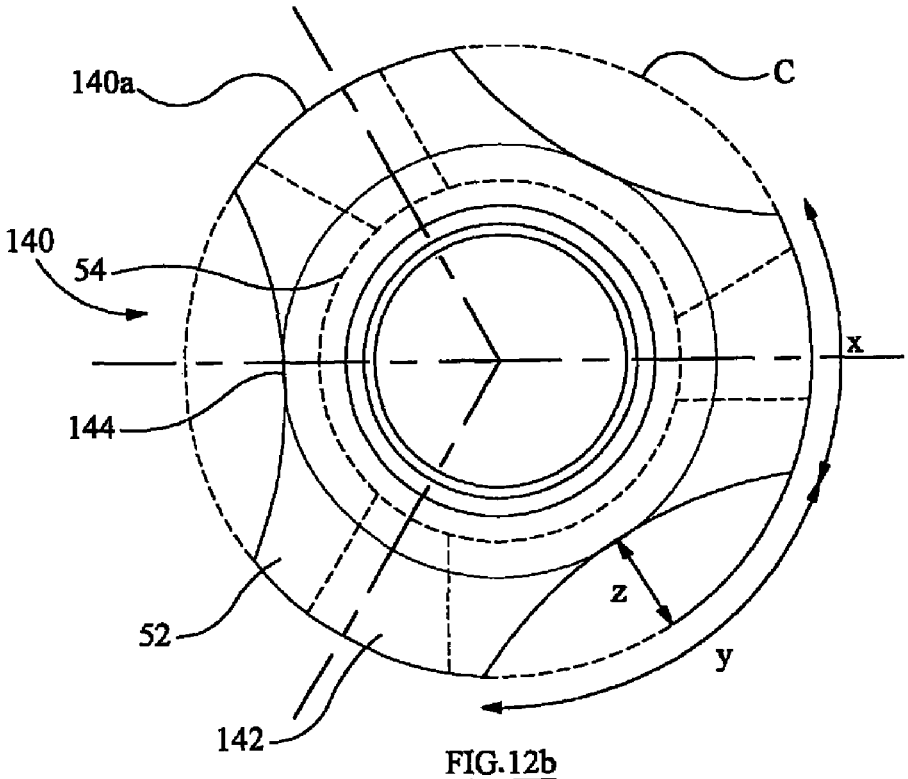

Referring to FIGS. 12*a* and 12*b*, a rotor 140 for dispersing gas and/or other treatment substances in molten metal is shown in side and plan view respectively. The rotor 140 is made from graphite and is of unitary construction. The rotor 140 is generally disc-shaped and comprises an annular upper part (roof 42), an annular lower part (base 44), a threaded throughbore 46 and an open chamber 48 as described previously. The roof 42 and the base 44 are connected by three dividers 142 equi-angularly spaced about the rotor 140 and disposed between the roof 42 and the base 44. The dividers 142 extend outwardly from the periphery of the chamber 48 to the peripheral surface of the rotor 140*a*. A passage 52 is defined between each pair of adjacent dividers 142, the roof 42 and the base 44, thereby providing a total of three passages 52. Each passage 52 has an inlet 54 from the chamber 48 and an outlet 56 on the peripheral surface of the rotor 140*a*. The peripheral surfaces of the roof 42 and base 44 are each provided with three part-circular cut-outs 144*a,b* (first and second cut-outs respectively). Rotor 140 is nominally circular (based on circle C). Each cut-out 144 extends a distance z from the peripheral surfaces of the roof 42 and base 44 and removes an arc y of circle C. Values of x, y and z for a rotor having a radius of 110 mm are given in table 3 below.

TABLE 3

| | x (mm) | y (mm) | z (mm) | z/r (%) | y/(x + y) |
|---|---|---|---|---|---|
| Ex. 10 (rotor 140) | 92.4 | 137.98 | 39.02 | 35.5 | 0.599 |

Example 11

Figure 13A:
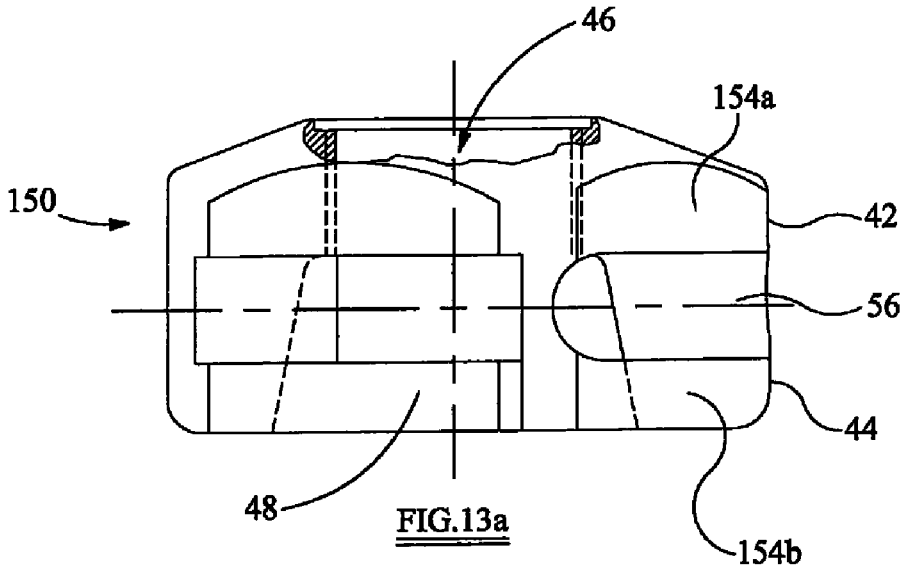
FIGS. 13*a* and 13*b* show a side and plan view respectively of an eleventh rotor in accordance with the invention.
Figure 13B:
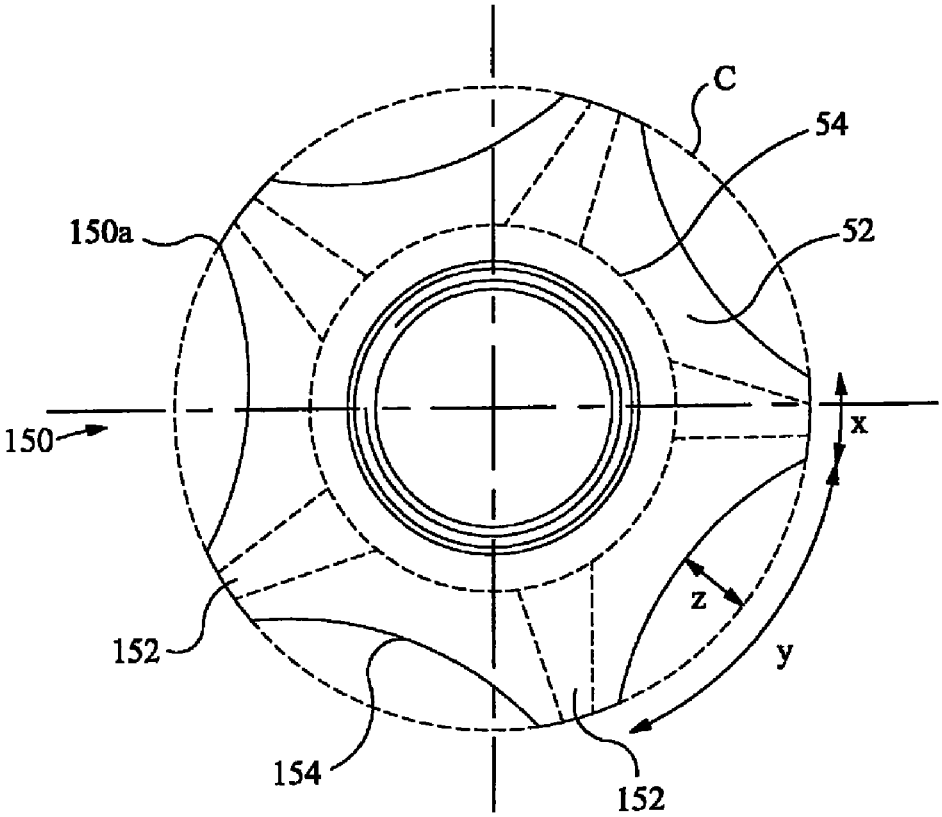

Referring to FIGS. 13*a* and 13*b*, a rotor 150 for dispersing gas and/or other treatment substances in molten metal is shown in side and plan view respectively. The rotor 150 is made from graphite and is of unitary construction. The rotor 150 is generally disc-shaped and comprises an annular upper part (roof 42), an annular lower part (base 44), a threaded throughbore 46 and an open chamber 48 as described previously. The roof 42 and base 44 are connected by five dividers 152 equi-angularly spaced about the rotor 150 and disposed between the roof 42 and base 44. The dividers 152 extend outwardly from the periphery of the chamber 48 to the peripheral surface of the rotor 150*a*. A passage 52 is defined between each pair of adjacent dividers 152, the roof 42 and the base 44, thereby providing a total of five passages 52. Each passage 52 has an inlet 54 from the chamber 48 and an outlet 56 on the peripheral surface of the rotor 150*a*. The peripheral surfaces of the roof 42 and base 44 are each provided with five part-circular cut-outs 154*a,b* (first and second cut-outs respectively). Rotor 150 is nominally circular (based on circle C). Each cut-out 154 extends a distance z from the peripheral surfaces of the roof 42 and base 44 and removes an arc y of circle C. Values of x, y and z for a rotor 150 having a radius of 87.5 mm are given in table 4 below.

TABLE 4

| | x (mm) | y (mm) | z (mm) | z/r (%) | y/(x + y) |
|---|---|---|---|---|---|
| Ex. 11 (rotor 150) | 22.51 | 87.45 | 20.49 | 23.4 | 0.795 |

Example 12

Figure 14A:
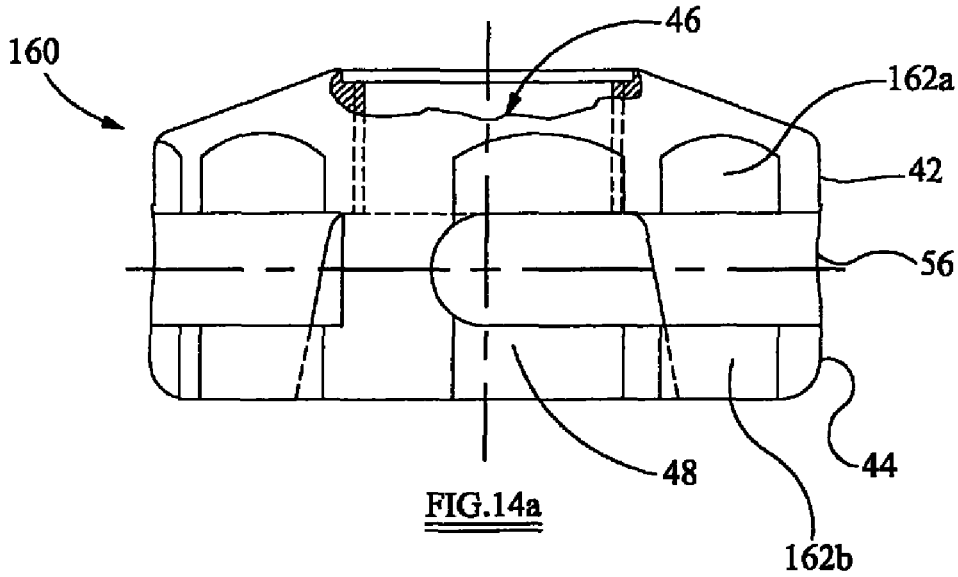
FIGS. 14*a* and 14*b* show a side and plan view respectively of a twelfth rotor in accordance with the invention.
Figure 14B:
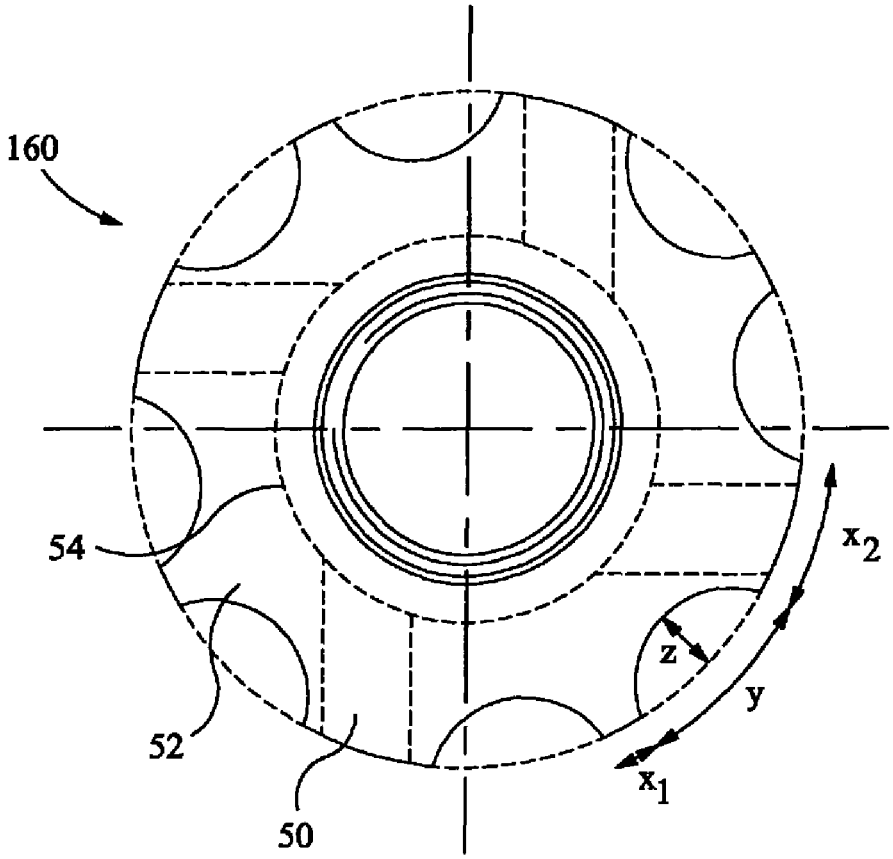

Referring to FIGS. 14*a* and 14*b*, a rotor 160 for dispersing gas and/or other treatment substances in molten metal is shown in side and plan view respectively. The rotor 160 is made from graphite and is of unitary construction. The rotor

160 is generally disc-shaped and is similar to rotor 40 (Ex. 1) in that it comprises an annular upper part (roof 42), an annular lower part (base 44), a throughbore 46, a chamber 48, four dividers 50 and four passages 52, each with a respective inlet 54 and outlet 56. Unlike rotor 40, rotor 160 has eight first cut-outs 162*a* in the roof 42 and eight second cut-outs 162*b* in the base 44, there are two first cut-outs 162*a* and two second cut-outs 162*b* per passage 52. The first cut-outs 162*a* and the second cut-outs 162*b* are in register i.e. when viewed from above, they coincide. Within a passage 52 the distance between adjacent first-cuts 162*a* or between adjacent second cut-outs 162*b* is labelled as $x_1$. Across a divider 50, the distance between adjacent first-cuts 162*a* or between adjacent second cut-outs 162*b* is labelled as $x_2$.

The ratio of the length of the arc of the circle circumference removed by the first or second cut-outs contiguous with a given passage (2y) multiplied by the number of passages (4), to the circumference of the circle ($8y+4x_1+4x_2$) is given by $2y/(2y+x_1+x_2)$.

Values of $x_1$, $x_2$, y and z for a rotor 160 having a radius of 87.5 mm are given in table 5 below.

TABLE 5

| | $x_1$ (mm) | $x_2$ (mm) | y (mm) | z (mm) | z/r (%) | $2y/(2y+x_1+x_2)$ |
|---|---|---|---|---|---|---|
| Ex. 12 (rotor 160) | 11.60 | 35.50 | 45.17 | 16.77 | 19.2 | 0.657 |

Example 13

Figure 15:
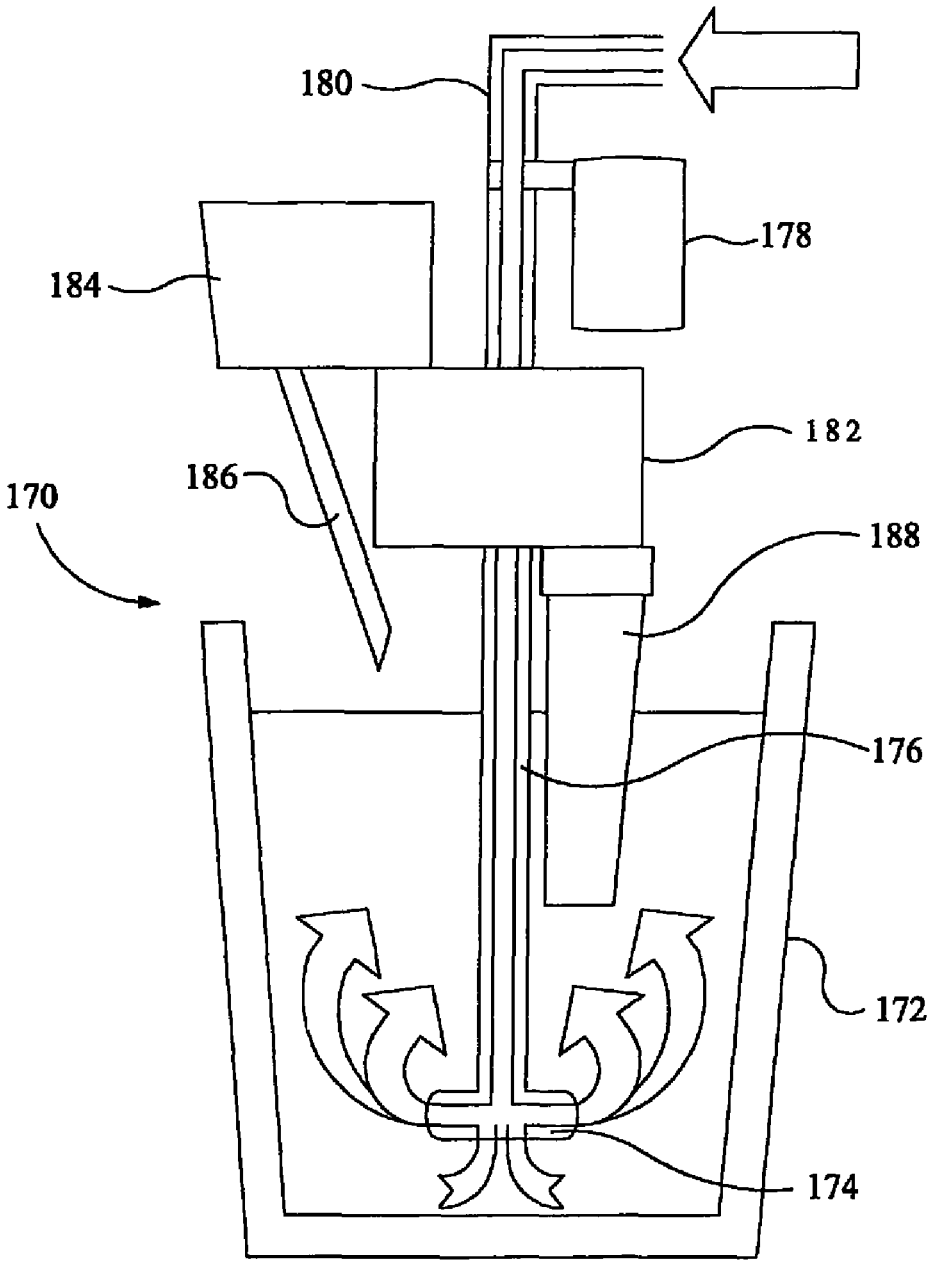
FIG. 15 shows a schematic representation of a metal treatment unit in accordance with the invention.

Referring to FIG. 15, a metal treatment unit 170 for degassing (Rotary Degassing Unit, RDU) and/or the addition of metal treatment substances (Metal Treatment Station, MTS) is shown schematically. The unit basically comprises a crucible 172 within which the metal to be treated is held, a graphite rotor 174 threadingly engaged to one end of a graphite shaft 176 (as previously described), a motor 178 and driveshaft 180, the driveshaft 180 being connected to the graphite rotor shaft 176 within a housing 182. The unit also comprises a hopper 184 and delivery tube 186 and a retractable baffle plate 188. The rest of the unit 170 is movable vertically relative to the crucible 172.

In use for degassing, the motor 178 is activated to rotate the shaft assembly 180,176 and the rotor 174 and the graphite shaft 176 is lowered into the crucible 172 containing the molten metal. Inert gas is passed through the driveshaft 180 and the graphite shaft 176 and into the metal via the rotor 174 and is dispersed within the molten metal. The baffle plate 188 is in its retracted position so that it sits above the molten metal.

When used as a combined metal treatment/degassing unit, the rotor 174 and graphite shaft 176 are driven relatively quickly so as to create a vortex within the melt. The metal treatment substances are then dosed into the melt from the hopper 184. After allowing sufficient time for mixing, the speed of the rotor 174 is reduced and the baffle plate 188 lowered into the melt to stop the vortex and reduce turbulence within the melt (as shown in FIG. 15). Degassing then proceeds as previously described.

Methodology

Two tests were developed in order to model the properties of rotary devices when in use for the treatment of molten metal. The first test models the effectiveness of rotary devices for degassing molten metal. The second test, a water model, demonstrates the likely effectiveness of rotary devices for distribution of metal treatment agents throughout the melt.

1. Degassing

Rotors having a radius of 87.5 mm attached to a shaft having a diameter of 75 mm were used to degas 280 kg of aluminium alloy (LM25: AlSi7Mg) held at 720° C. The gas used was dry nitrogen at a flow rate of 15 L/minute. The speed of rotation was 320 rpm and degassing was carried out over 4 minutes. The effectiveness was assessed by measuring the concentration of dissolved hydrogen in the melt using an ALSPEK H electronic sensor sold by Foseco, which gave a direct measurement of the hydrogen level in the molten metal: The molten metal was stirred using the rotor (without gas) and the sensor was held in the melt. Gas was then introduced down the shaft of the rotor and the hydrogen level in the melt was measured and recorded at 10 second intervals.

2. Water Model

The addition of metal treatment agents to a melt was simulated using a water model in which lightweight plastic pellets were used to observe vortex formation and coloured dye (food colouring) was used to observe mixing. Rotors were tested in a Foseco Metal Treatment Station (MTS 1500 Mark 10) with a cylindrical transparent vessel (650 mm diameter, 900 mm high) used in place of a crucible. Each rotor had a radius of 110 mm and was attached to a shaft having a diameter of 75 mm and a length of 1000 mm.

2.1 Vortex Formation

The first step to assessing rotor efficiency was to determine the rotation speed for each rotor that was necessary to give a standard equivalent vortex dimension. To achieve this plastic pellets were first added to the transparent vessel that had been filled with water to a height L1 (735 mm, normal bath height). The plastic pellets floated on the surface of the water until each rotor was lowered into the bath and rotated to form a vortex. The speed of rotation was then adjusted so that the plastic pellets touched the rotor but did not disperse in the crucible. The height of the water was measured when the vortex was formed (L2, bath height with formed vortex) as well as the time required for this vortex to form.

An efficiency factor for vortex formation may be calculated using the following formula:

$$\text{Efficiency factor}=\{(L2-L1)/L1\}\times\text{vortex formation time}$$

The lower the value of the efficiency factor, the more efficient the rotor is for vortex formation.

2.2 Determination of Mixing Time

To determine mixing efficiency, the rotors were lowered into the plastic vessel containing water at a height 755 mm. The height of the bath was raised to a level 20 mm above that used in the vortex formation study (section 2.1 above). The bath height was changed to reflect the natural variability of bath height in use. A higher bath height was chosen as this will work the rotors harder and, in theory at least, is likely to emphasise the differences between the more and less efficient rotors. A vortex was formed (without plastic pellets) using the rotational speeds determined in 2.1. Once the vortex was steady, 3 ml food colouring was added into the vortex and the time for the food colouring to mix evenly throughout the vessel was measured.

Rotors

Ten rotors in accordance with the invention were made and tested together with six others for purpose of comparison (four prior art rotors and two newly designed rotors falling outside the scope of the invention). Each rotor was made in two sizes—a rotor having a radius of 87.5 mm was employed in the degassing experiments and a larger version, having a radius of 110 mm, was employed for the water model. The use of two slightly different diameter rotors for the water modelling and degassing trials was necessitated by the different size vessels used. Both size rotors were attached to the same diameter shaft and therefore had the same size bore in the upper surface (to accept/attach the shaft), whereas the chamber in the base had a diameter in proportion to the overall diameter of each rotor. For this reason, the inward extent of the cut outs in the degassing rotors was slightly less than the corresponding water modelling rotors, resulting in a slightly smaller z/r ratio. However, the differences are trivial and do not affect the conclusions made on efficiency.

1. Degassing

For each of the rotors the concentration of dissolved hydrogen in the melt, measured at ten second intervals, is shown in table 6 and the time taken to reach a given hydrogen concentration (estimated from a best fit plot and rounded to the nearest 5 seconds) is given in table 7.

Effect of Cut-Outs in the Roof and in the Base (Ex.2 and Comp. Ex. A)

Figure 16:
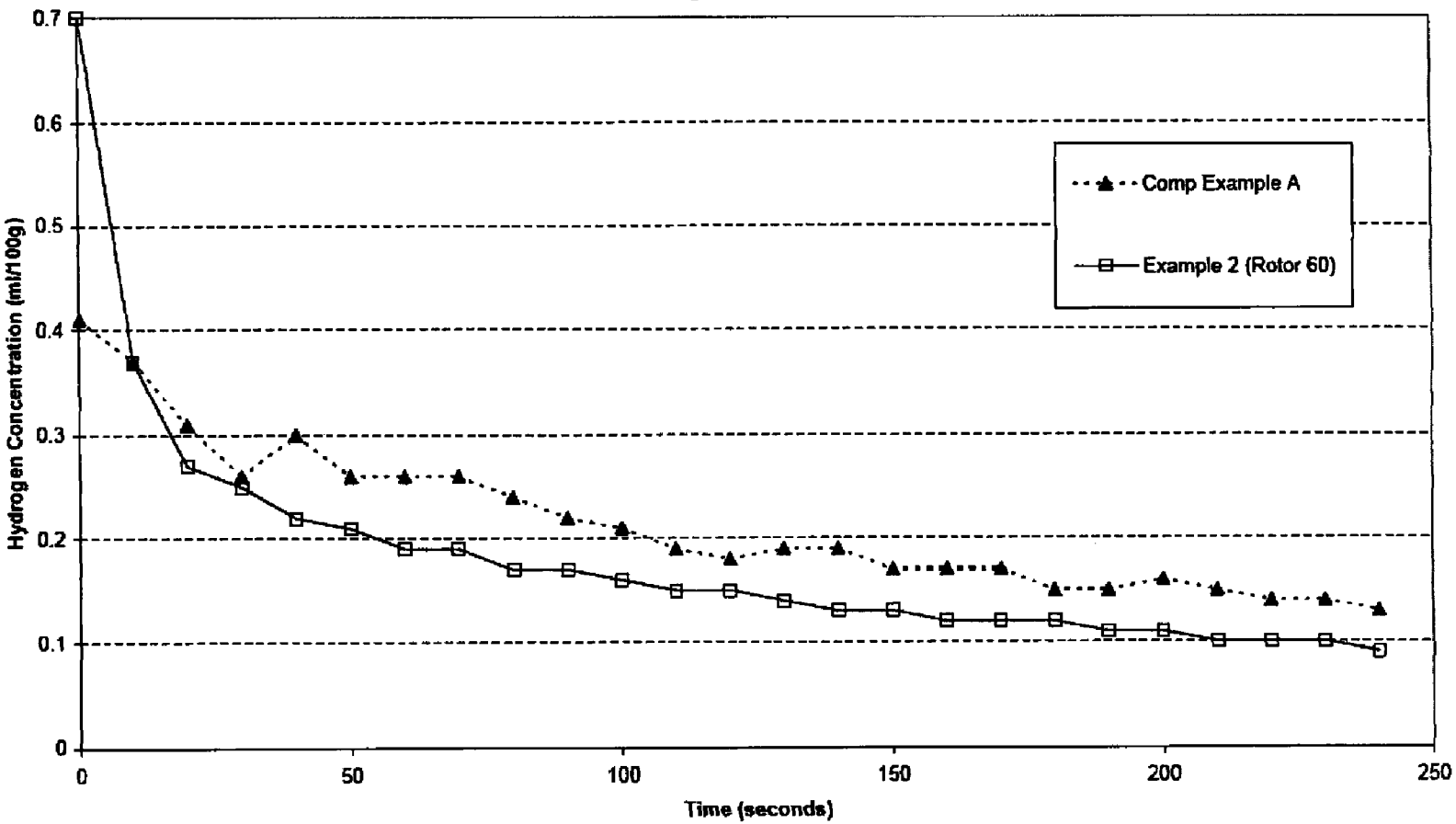
FIGS. 16 and 18 to 22 show graphs of reduction in the hydrogen concentration of a melt when using rotary devices of the present invention, prior art rotary devices and also rotary devices which fall outside the scope of the present invention.

In order to investigate the effect of having cut-outs in the roof and base instead of just in the roof, two new rotors were designed, rotor 60 (Ex.2) described above and Comp. Ex. A. The Comp. Ex. A rotor is identical to rotor 60 (it has the same size and shape of cut-outs in the roof) except that it does not have cut-outs in the base. Graphs of the reduction in hydrogen concentration over time were plotted for both rotors and are shown in FIG. 16. It can be seen that when rotor 60 is used, the hydrogen concentration in the melt drops off very quickly and eventually reaches a concentration below 0.1 ml/100 g melt. The time required for the hydrogen concentration to drop to 0.20 ml/100 g melt is just 55s for rotor 60 whereas for Comp. Ex. A, the time required is 105s. Therefore the presence of cut-outs in the base, as well as in the roof, appears to improve the degassing properties of a rotary device.

TABLE 6

| Time (s) | Ex. 1 | Ex. 2 | Ex. 3 | Ex. 4 | Ex. 5 | Ex. 6 | Ex. 7 | Ex. 8 | Ex. 9 | Ex. 10 | Prior Art 1 | Prior Art 2 | Prior Art 3 | Prior Art 4 | Comp. Ex A | Comp. Ex. B |
|---|---|---|---|---|---|---|---|---|---|---|---|---|---|---|---|---|
| 0 | 0.49 | 0.70 | 0.60 | 0.50 | 0.57 | 0.58 | 0.52 | 0.53 | 0.48 | 0.58 | 0.47 | 0.50 | 0.63 | 0.52 | 0.41 | 0.51 |
| 10 | 0.47 | 0.37 | 0.34 | 0.43 | 0.57 | 0.54 | 0.47 | 0.42 | 0.44 | 0.45 | 0.35 | 0.49 | 0.56 | 0.54 | 0.37 | 0.50 |
| 20 | 0.29 | 0.27 | 0.31 | 0.27 | 0.45 | 0.39 | 0.32 | 0.31 | 0.33 | 0.30 | 0.34 | 0.41 | 0.55 | 0.57 | 0.31 | 0.33 |
| 30 | 0.27 | 0.25 | 0.31 | 0.26 | 0.31 | 0.32 | 0.30 | 0.28 | 0.32 | 0.27 | 0.37 | 0.26 | 0.56 | 0.49 | 0.26 | 0.29 |
| 40 | 0.27 | 0.22 | 0.30 | 0.26 | 0.31 | 0.30 | 0.28 | 0.28 | 0.31 | 0.27 | 0.34 | 0.30 | 0.53 | 0.49 | 0.30 | 0.27 |
| 50 | 0.23 | 0.21 | 0.27 | 0.24 | 0.29 | 0.27 | 0.27 | 0.26 | 0.28 | 0.27 | 0.34 | 0.28 | 0.51 | 0.34 | 0.26 | 0.25 |
| 60 | 0.22 | 0.19 | 0.25 | 0.25 | 0.28 | 0.25 | 0.27 | 0.24 | 0.24 | 0.24 | 0.31 | 0.29 | 0.52 | 0.35 | 0.26 | 0.25 |
| 70 | 0.21 | 0.19 | 0.25 | 0.22 | 0.27 | 0.23 | 0.25 | 0.23 | 0.24 | 0.23 | 0.29 | 0.26 | 0.45 | 0.37 | 0.26 | 0.23 |
| 80 | 0.20 | 0.17 | 0.23 | 0.21 | 0.25 | 0.22 | 0.23 | 0.23 | 0.22 | 0.21 | 0.29 | 0.23 | 0.42 | 0.28 | 0.24 | 0.23 |
| 90 | 0.18 | 0.17 | 0.22 | 0.20 | 0.22 | 0.21 | 0.24 | 0.21 | 0.22 | 0.22 | 0.28 | 0.26 | 0.43 | 0.34 | 0.22 | 0.22 |
| 100 | 0.19 | 0.16 | 0.21 | 0.19 | 0.22 | 0.20 | 0.22 | 0.21 | 0.20 | 0.19 | 0.31 | 0.23 | 0.46 | 0.30 | 0.21 | 0.21 |
| 110 | 0.18 | 0.15 | 0.20 | 0.18 | 0.20 | 0.19 | 0.22 | 0.18 | 0.19 | 0.19 | 0.29 | 0.25 | 0.41 | 0.31 | 0.19 | 0.2 |
| 120 | 0.17 | 0.15 | 0.20 | 0.18 | 0.20 | 0.18 | 0.22 | 0.19 | 0.17 | 0.18 | 0.28 | 0.24 | 0.42 | 0.35 | 0.18 | 0.20 |
| 130 | 0.17 | 0.14 | 0.18 | 0.18 | 0.19 | 0.17 | 0.19 | 0.17 | 0.17 | 0.17 | 0.30 | 0.22 | 0.46 | 0.33 | 0.19 | 0.18 |
| 140 | 0.15 | 0.13 | 0.17 | 0.16 | 0.18 | 0.16 | 0.20 | 0.16 | 0.15 | 0.16 | 0.27 | 0.21 | 0.42 | 0.31 | 0.19 | 0.18 |
| 150 | 0.15 | 0.13 | 0.17 | 0.15 | 0.18 | 0.15 | 0.19 | 0.16 | 0.16 | 0.16 | 0.27 | 0.21 | 0.40 | 0.32 | 0.17 | 0.17 |
| 160 | 0.15 | 0.12 | 0.17 | 0.16 | 0.17 | 0.14 | 0.18 | 0.15 | 0.15 | 0.15 | 0.25 | 0.22 | 0.37 | 0.30 | 0.17 | 0.17 |
| 170 | 0.14 | 0.12 | 0.16 | 0.15 | 0.15 | 0.13 | 0.18 | 0.15 | 0.14 | 0.15 | 0.25 | 0.20 | 0.38 | 0.29 | 0.17 | 0.16 |
| 180 | 0.14 | 0.12 | 0.15 | 0.14 | 0.15 | 0.13 | 0.17 | 0.14 | 0.14 | 0.15 | 0.25 | 0.20 | 0.38 | 0.27 | 0.15 | 0.16 |
| 190 | 0.14 | 0.11 | 0.14 | 0.13 | 0.15 | 0.12 | 0.17 | 0.13 | 0.13 | 0.14 | 0.25 | 0.20 | 0.36 | 0.26 | 0.15 | 0.15 |
| 200 | 0.14 | 0.11 | 0.14 | 0.13 | 0.14 | 0.12 | 0.17 | 0.13 | 0.13 | 0.14 | 0.24 | 0.19 | 0.35 | 0.28 | 0.16 | 0.15 |
| 210 | 0.13 | 0.10 | 0.13 | 0.13 | 0.14 | 0.11 | 0.15 | 0.13 | 0.13 | 0.13 | 0.23 | 0.18 | 0.37 | 0.29 | 0.15 | 0.14 |
| 220 | 0.13 | 0.10 | 0.13 | 0.12 | 0.13 | 0.11 | 0.16 | 0.12 | 0.13 | 0.13 | 0.22 | 0.20 | 0.34 | 0.25 | 0.14 | 0.14 |
| 230 | 0.12 | 0.10 | 0.13 | 0.12 | 0.13 | 0.10 | 0.16 | 0.12 | 0.12 | 0.12 | 0.21 | 0.18 | 0.35 | 0.25 | 0.14 | 0.13 |
| 240 | 0.12 | 0.09 | 0.12 | 0.12 | 0.13 | 0.10 | 0.14 | 0.11 | 0.11 | 0.12 | 0.20 | 0.19 | 0.33 | 0.24 | 0.13 | 0.13 |

TABLE 7

| | Time (s) to reach n ml $H_2$/100 g melt | | | | | | |
|---|---|---|---|---|---|---|---|
| | 0.24 | 0.22 | 0.20 | 0.18 | 0.16 | 0.14 | 0.12 |
| Ex. 1 | 45 | 60 | 80 | 100 | 130 | 170 | 230 |
| Ex. 2 | 35 | 40 | 55 | 75 | 100 | 130 | 160 |
| Ex. 3 | 75 | 90 | 110 | 130 | 170 | 200 | 240 |
| Ex. 4 | 55 | 70 | 90 | 110 | 140 | 180 | 220 |
| Ex. 5 | 85 | 95 | 110 | 140 | 165 | 200 | n/a |
| Ex. 6 | 65 | 80 | 100 | 120 | 135 | 155 | 190 |
| Ex. 7 | 75 | 100 | 125 | 155 | 205 | 235 | n/a |
| Ex. 8 | 60 | 85 | 105 | 120 | 135 | 180 | 220 |
| Ex. 9 | 65 | 80 | 100 | 115 | 135 | 170 | 230 |
| Ex. 10 | 60 | 80 | 95 | 115 | 140 | 185 | 225 |
| Prior Art 1 | 200 | 220 | 240 | n/a | n/a | n/a | n/a |
| Prior Art 2 | 80 | 130 | 170 | 205 | n/a | n/a | n/a |
| Prior Art 3 | n/a | n/a | n/a | n/a | n/a | n/a | n/a |
| Prior Art 4 | 240 | n/a | n/a | n/a | n/a | n/a | n/a. |
| Comp. Ex. A | 80 | 90 | 105 | 120 | 175 | 210 | 240 |
| Comp. Ex. B | 65 | 90 | 110 | 130 | 165 | 205 | 230 |

Effect of Extent of Part-Circular Cut-Outs (Prior Art Rotor 3 and Examples 1 to 4)

Figure 17A:
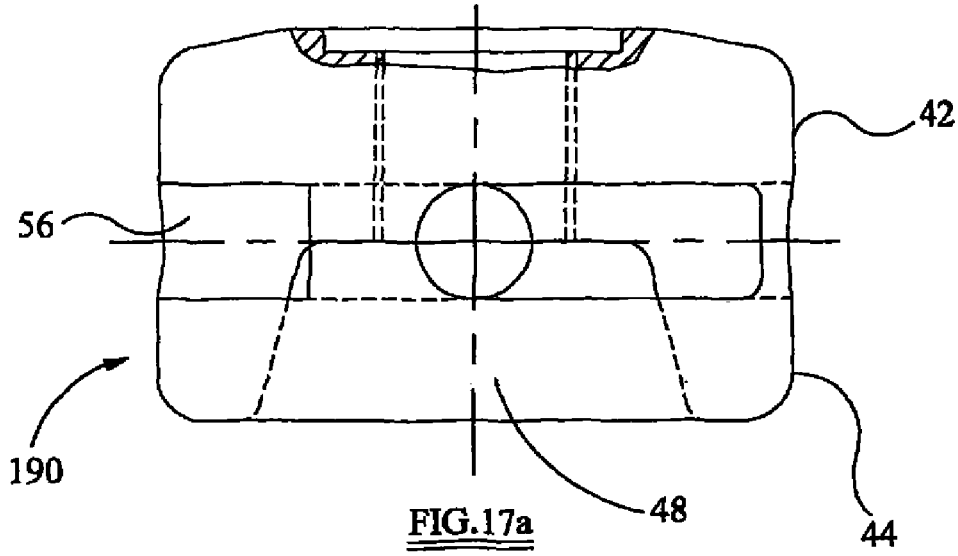
FIGS. 17*a* and 17*b* show a side and plan view respectively of an SPR (prior art) rotor.
Figure 17B:
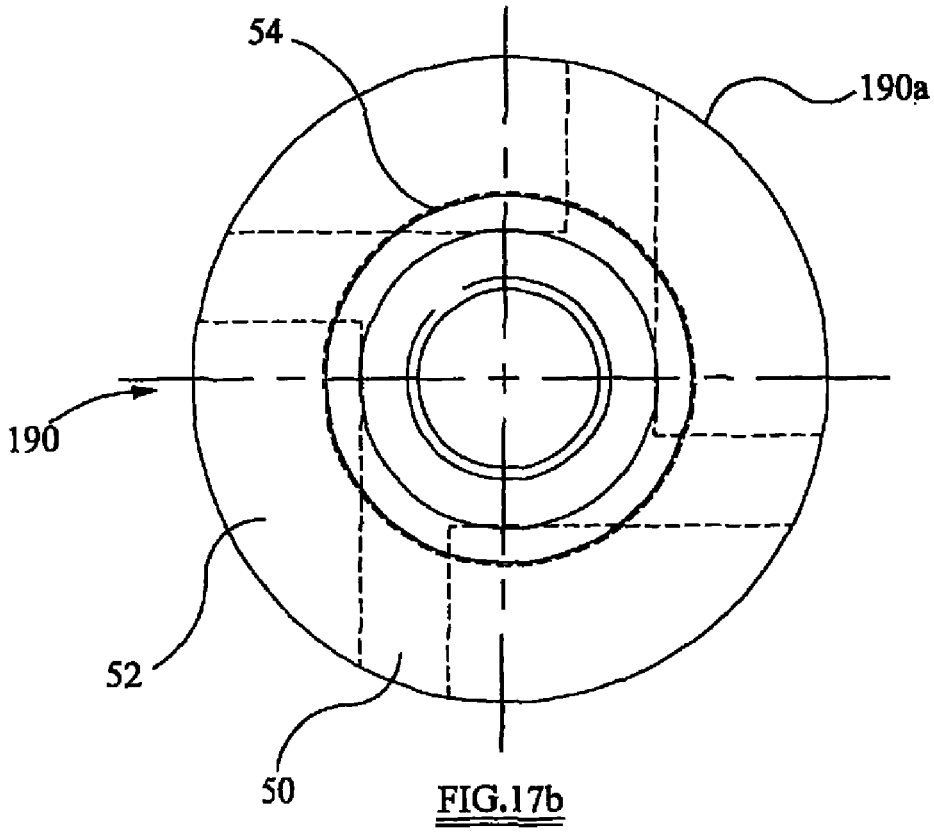

A series of rotors were designed in order to investigate the effect of the extent of the part-circular cut-outs on rate of degassing, examples 1 to 4. Each of the rotors 40, 60, 70 and 80 have four part-circular cut-outs in each of the roof and base which extend inwardly for a similar distance (similar z/r values) but the extent of the cut-outs increase in the order 80, 70, 60, 40. These rotors were tested alongside Prior art rotor 3, the SPR (Foseco), shown in side and plan view in FIGS. 17*a* and 17*b* respectively. The SPR rotor 190 has a substantially similar configuration to the rotors of the invention, being generally disc-shaped with an annular upper part (roof 42) and an annular lower part (base 44) spaced apart and connected by a four dividers 50 equi-angularly spaced about the rotor 190. A passage 52 is defined between each pair of dividers 50 and the roof 42 and base 44, each passage having an inlet 54 in an inner surface of the rotor and an outlet 56 in a peripheral surface of the rotor 190*a*. Each outlet 56 has a greater cross-sectional area than the respective inlet 54 and is radially disposed outward therefrom. An open chamber 48 is provided centrally in the base 44 and extends upwardly to the roof 42. The SPR rotor has no cut-outs and therefore has x, y and z values of zero. The x, y and z values and corresponding ratios for rotors having a radius of 87.5 mm are shown in table 8 below.

TABLE 8

| | x (mm) | y (mm) | z (mm) | z/r (%) | y/(x + y) |
|---|---|---|---|---|---|
| Prior art rotor 3 (SPR) | 0 | 0 | 0 | 0 | 0 |
| Ex. 4 (rotor 80) | 100.79 | 36.65 | 24.35 | 27.8 | 0.267 |
| Ex. 3 (rotor 70) | 87.05 | 50.40 | 24.76 | 28.3 | 0.367 |
| Ex. 2 (rotor 60) | 48.87 | 88.85 | 25.17 | 28.8 | 0.645 |
| Ex. 1 (rotor 40) | 24.43 | 113.01 | 24.22 | 27.7 | 0.822 |

Figure 18:
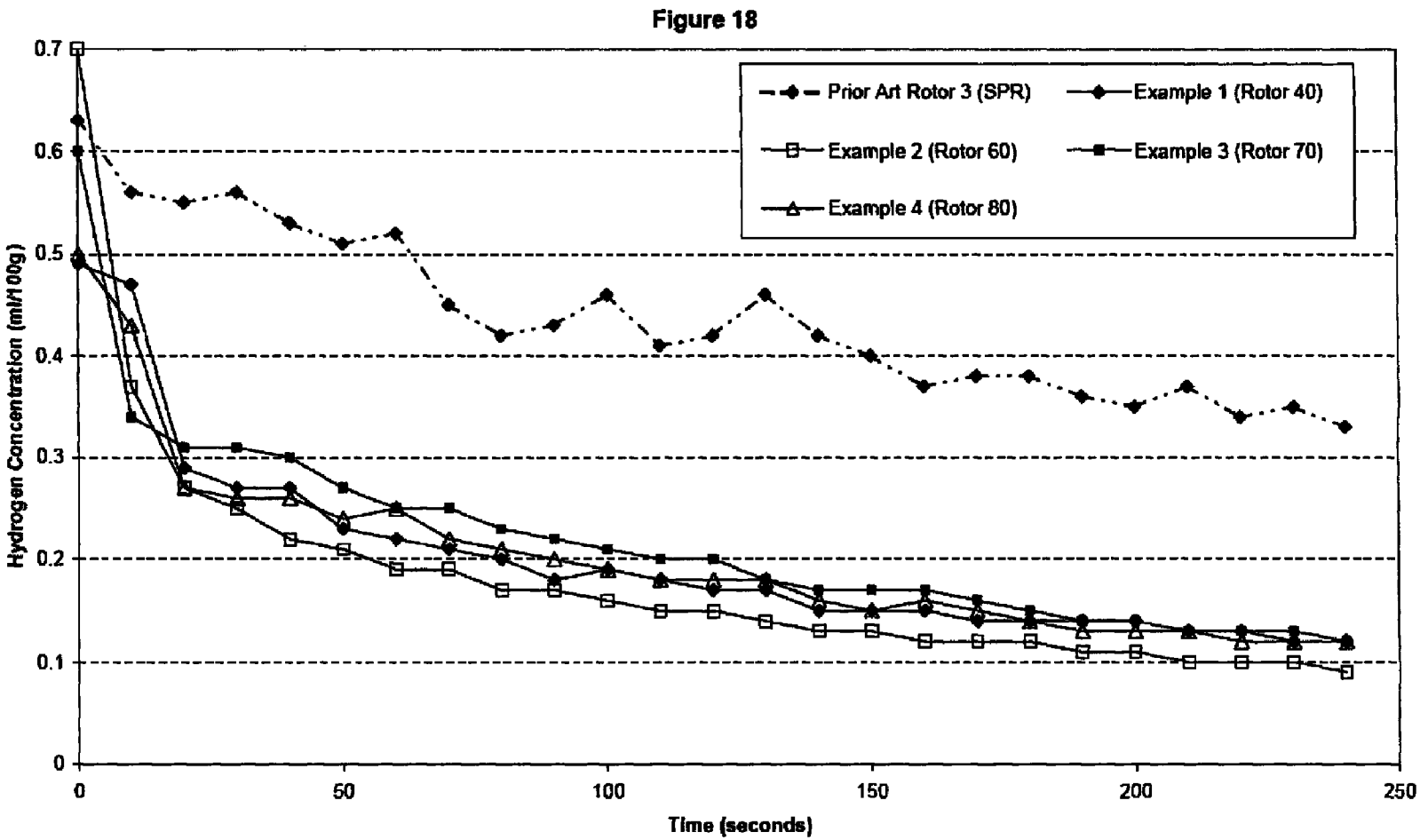

A graph of reduction in hydrogen concentration over time was plotted for each of these rotors and is shown in FIG. 18. It is immediately clear that all of the rotors of the invention (80, 70, 60 and 40) are superior to prior art rotor 3, SPR, for degassing. The SPR never reaches a hydrogen concentration of 0.3 ml/100 g melt whereas the rotors 80, 70, 60, and 40 reach a hydrogen concentration of 0.2 ml/100 within 90, 110, 55, and 80 seconds respectively. From a review of the graph, it appears that rotor 60 (Ex. 2) is the most successful rotor for degassing having the lowest hydrogen concentration for most of the test period.

Effect of Extent of Straight Cut-Outs (Examples 7, 8 and 9)

A series of rotors were designed in order to investigate the effect of the extent of straight edged cut-outs on rate of degassing, rotors 110, 120 and 130 described above. These rotors all have four straight edged cut-outs in the roof and base, with the length of the cut-out (indicated by the value for y/(x+y)) increasing in the order 110, 120, 130. x, y and z values and corresponding ratios for rotors having a radius of 87.5 mm are shown in table 9 below.

TABLE 9

| | x (mm) | y (mm) | z (mm) | z/r (%) | y/(x + y) |
|---|---|---|---|---|---|
| Ex. 7 (rotor 110) | 48.86 | 88.58 | 11.64 | 13.3 | 0.644 |
| Ex. 8 (rotor 120) | 24.43 | 113.01 | 17.62 | 20.1 | 0.822 |
| Ex. 9 (rotor 130) | 0 | 137.44 | 25.63 | 29.3 | 1.000 |

Figure 19:
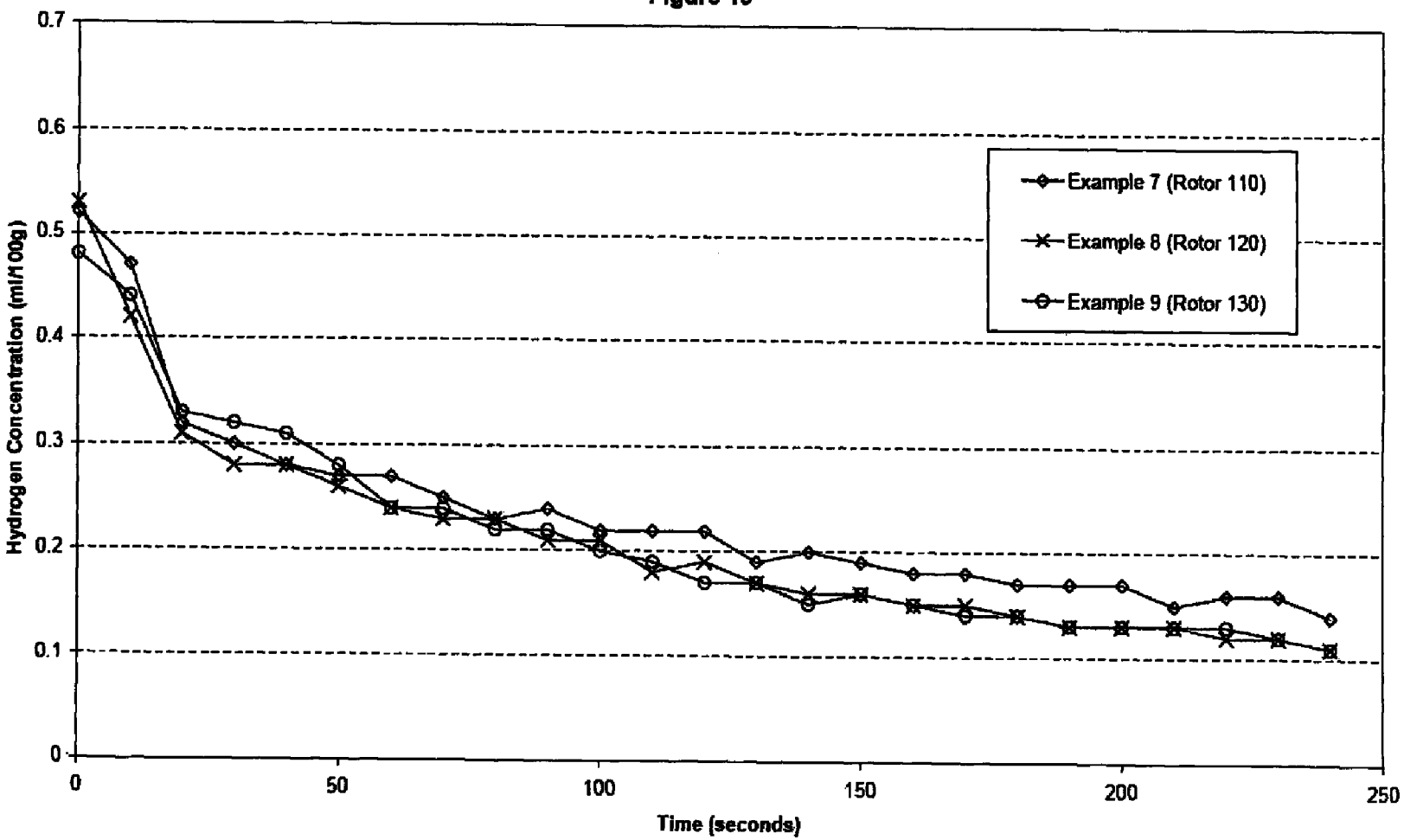

A graph to show the reduction in hydrogen concentration over time for each of the rotors was plotted and is shown in FIG. 19. Rotors 110, 120 and 130 all appear to degas well with 120 and 130 resulting in a slightly lower final hydrogen concentration than 110. This suggests that a greater extent of cut-out (larger value for y/(x+y)) results in a more successful rotor for degassing.

Effect of Depth of Cut-Outs (Examples 2, 6 and 7)

A series of rotors were designed in order to investigate the effect of the depth of cut-outs, i.e. the maximum distance which the cut-outs extend inwardly from the peripheral surfaces of the roof and base of the rotor, on rate of degassing. Rotors 110, 60 and 100 are described above. The cut-outs in rotor 110 have a straight edge and those in rotors 60 and 110 are part-circular. They each remove the same length of arc (same y/(x+y) values) but vary in depth of cut-out in the order 110, 60, 100. Values of x, y and z for these rotors are listed in table 10 below.

TABLE 10

| | x (mm) | y (mm) | z (mm) | z/r (%) | y/(x + y) |
|---|---|---|---|---|---|
| Ex. 7 (rotor 110) | 48.86 | 88.58 | 11.73 | 13.3 | 0.644 |
| Ex. 2 (rotor 60) | 48.86 | 88.58 | 25.17 | 28.7 | 0.644 |
| Ex. 6 (rotor 100) | 48.86 | 88.58 | 38.89 | 44.5 | 0.644 |

Figure 20:
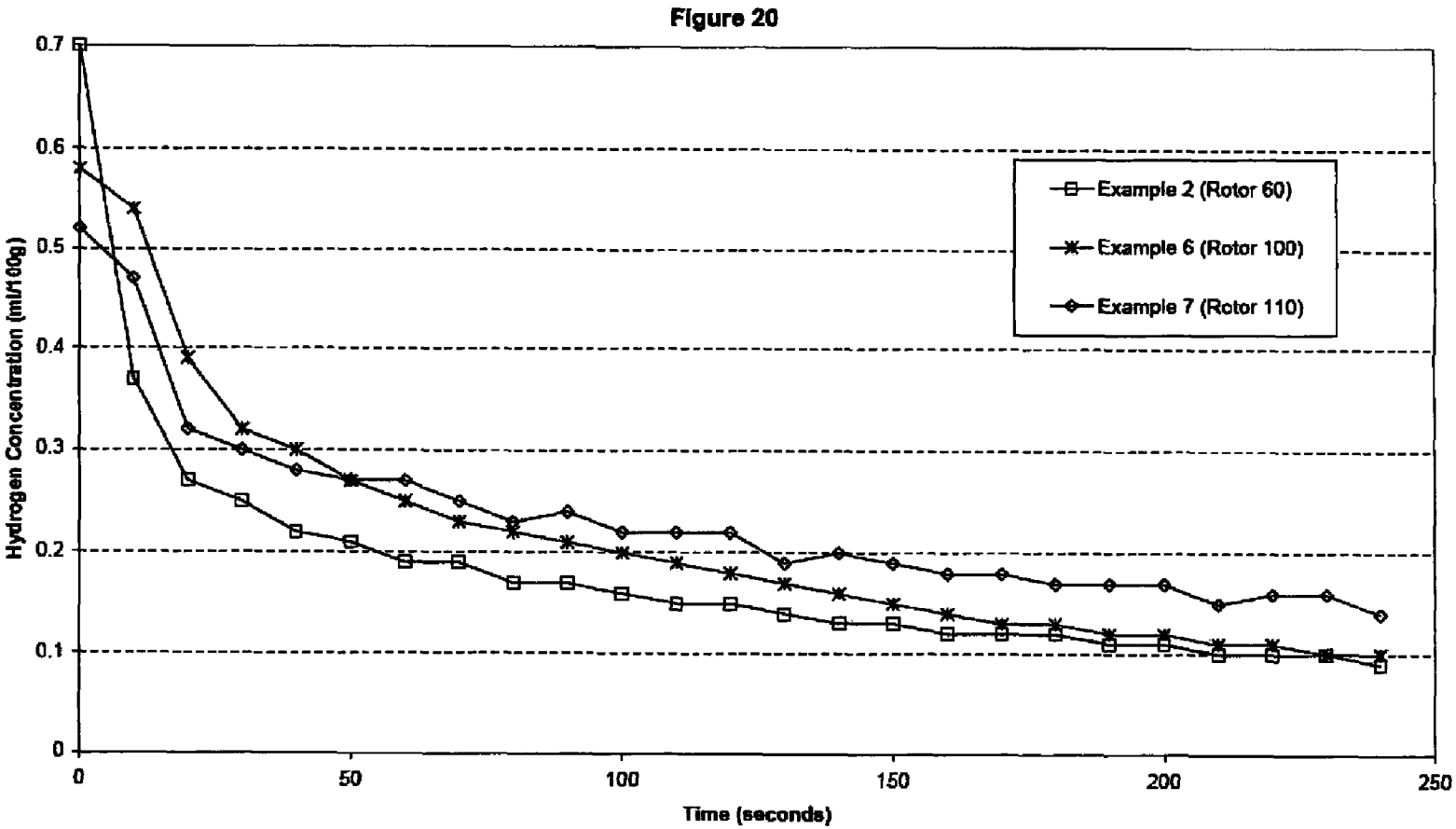

A graph was plotted to show the reduction in hydrogen concentration over time for each of the rotors and is shown in FIG. 20. All of the rotors are successful for degassing. Their use results in a reduction in hydrogen concentration to 0.2 ml/100 g in 25s (110), 55s (60) and 100s (100). Rotors 60 and 100 are more successful, reaching a final hydrogen concentration of less than 0.12 ml/100 g melt. This indicates that a deeper cut (larger z/r value) is useful when degassing.

Effect of Chamber and Cross-Sectional Area of Outlets and Inlets (Ex. 2 and Comp. Ex. B)

Comp. Ex. B was designed to investigate the effect of having no chamber and a passage of uniform width due to being defined by an inlet and outlet of equal cross-sectional area as compared to the rotors of the invention which have a chamber for the mixing of gas and molten metal and in which the cross-sectional area of the outlet is greater than the cross-sectional area of the respective inlet.

Comp. Ex. B is similar to the Diamant™ rotor described previously, being generally disc-shaped and comprising four radial bores equi-angularly spaced around the rotor. Each bore extends from the inner surface of the rotor to its peripheral surface thereby providing an outlet for gas. Comp. Ex. B has four cut-outs that extend inwardly from the peripheral surface of the rotor. Each cut-out is located at an outlet and extends downwardly for the entire depth of the rotor. There is no chamber for the mixing of gas and molten metal. The cut-outs of Comp. Ex. B are the same size and shape as the cut-outs in rotor 60 (Ex. 2) so the x, y, and z values for the rotors are the same.

Figure 21:
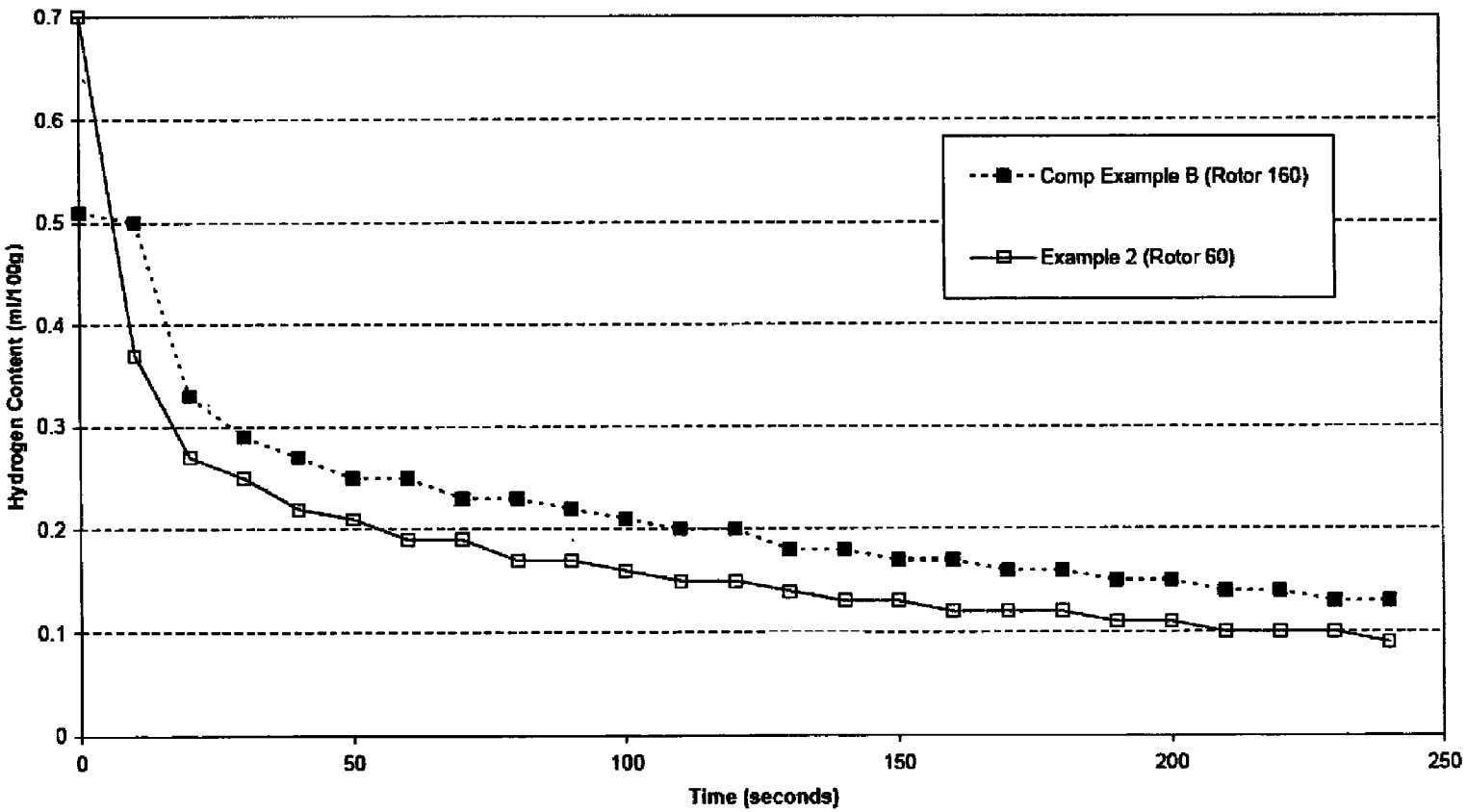

A graph was plotted to show the reduction in hydrogen concentration over time for each rotor and is shown in FIG. 21. The hydrogen concentration decreases more quickly when rotor 60 (Ex. 2) is used than when Comp. Ex. B is used. The hydrogen concentration when rotor 60 (Ex. 2) is used is lower than the hydrogen concentration when Comp. Ex. B is used for the almost all of the duration of the test. This indicates that the presence of a chamber and outlets having a greater cross-sectional area than the respective inlets provides a beneficial effect for degassing.

Effect of Chamber and Outlets (Prior Art Rotor 4 and Ex. 9)

Ex. 9 is similar to a prior art rotor known as the "Brick" (sold by Pyrotek Inc.) except that Ex. 9 has outlets and a chamber. The "Brick" rotor is simply a solid block of graphite with no inlets, outlets or chamber. It is square in transverse cross-section (orthogonal to the shaft axis) but can be viewed as being based on a circle having four straight edged cut-outs, in the same way as rotor 130 (Ex. 9). Values of x, y and z for Ex. 9 and the "Brick" are identical and shown in table 11 below for rotors having a diameter of 87.5 mm.

TABLE 11

| | x (mm) | y (mm) | z (mm) | z/r (%) | y/(x + y) |
|---|---|---|---|---|---|
| Prior art rotor 4 ("Brick") | 0 | 137.44 | 25.63 | 29.3 | 1.000 |
| Ex. 9 | 0 | 137.44 | 25.63 | 29.3 | 1.000 |

Figure 22:
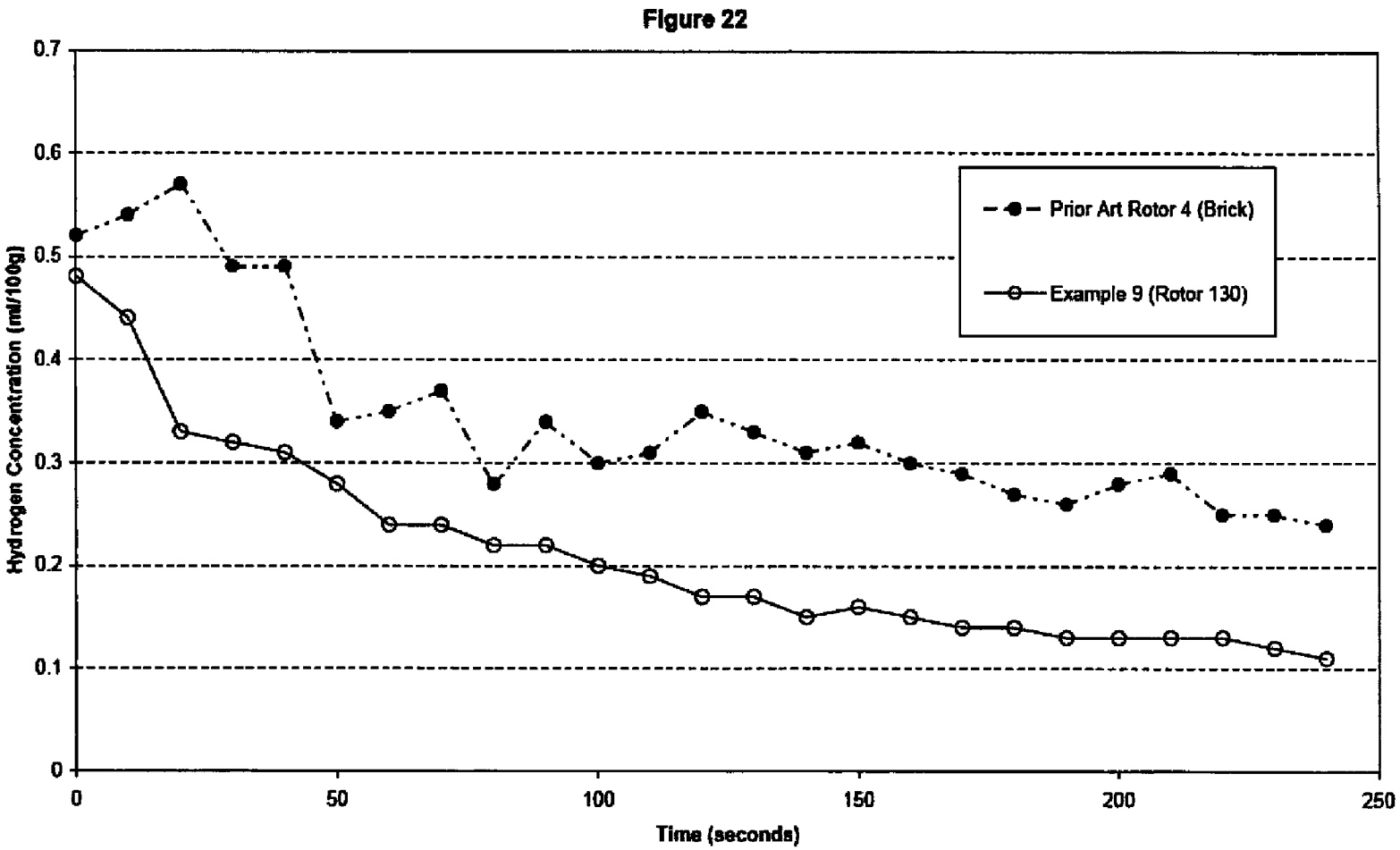

A graph was plotted to show the reduction in hydrogen concentration over time for each rotor and is shown in FIG. 22. The hydrogen concentration decreases much more quickly and reaches a lower final value when rotor 130 (Ex. 9) is used than when prior art rotor 4 ("Brick") is used. The hydrogen concentration is consistently lower when the rotor of the invention is used compared to when the prior art "Brick" rotor is used indicating that the presence of outlets and a chamber improve the degassing properties of a rotor.

All of the prior art rotors (SPR, XSR, Diamant™ and "Brick") were less successful than the rotors of the invention for degassing. The SPR, XSR and "Brick" failed to reach a hydrogen concentration of 0.2 ml/100 g and although the Diamantm rotor reached 0.2 ml/100 g, it took 170 s to do so, considerably longer than any of the rotors of the invention.

2. Water Model—Vortex Formation

Experiments were carried out as described above on rotor examples 1 to 10, prior art rotors and two new rotors that are not within the scope of the invention. An Efficiency Factor (E.F) for each rotor was calculated using the formula above and the values given in table 12 below.

TABLE 12

| | L1 (mm) | L2 (mm) | Time to form vortex (s) | Efficiency factor (E.F) |
|---|---|---|---|---|
| Prior Art 1 | 735 | 830 | 27 (half vortex only) | 3.5 |
| Prior Art 2 | 735 | 800 | n/a vortex inadequate | n/a |
| Prior Art 3 | 735 | 805 | n/a vortex inadequate | n/a |
| Prior Art 4 | 735 | 865 | 17 | 3.0 |
| Comp. Ex. A | 735 | 830 | 23 | 3.0 |
| Comp. Ex. B | 735 | 820 | 23 | 2.7 |
| Ex. 1 | 735 | 820 | 22 | 2.5 |
| Ex. 2 | 735 | 830 | 20 | 2.6 |
| Ex. 3 | 735 | 830 | 25 | 3.2 |
| Ex. 4 | 735 | 830 | 26 | 3.4 |
| Ex. 5 | 735 | 820 | 22 | 2.5 |
| Ex. 6 | 735 | 820 | 19 | 2.2 |
| Ex. 7 | 735 | 850 | 23 | 3.6 |
| Ex. 8 | 735 | 820 | 28 | 3.2 |
| Ex. 9 | 735 | 845 | 19 | 2.8 |
| Ex. 10 | 735 | 820 | 23 | 2.7 |

Experiments were carried out as described above to determine the time required for a coloured dye to be uniformly mixed throughout the water. The times taken and the rotation speed used (determined in 2.1) are listed in table 13 below.

TABLE 13

| | Rotational speed (rpm) | Uniform mixing time (s) |
|---|---|---|
| Prior Art 1 | 420 (half vortex) | 8 |
| Prior Art 2 | 500 (vortex inadequate) | 12 |
| Prior Art 3 | 500 (vortex inadequate) | 10 |
| Prior Art 4 | 305 | 7 |
| Comp. Ex. A | 350 | 7 |
| Comp. Ex. B | 390 | 5 |
| Ex. 1 | 360 | 6 |
| Ex. 2 | 350 | 4 |
| Ex. 3 | 355 | 7 |
| Ex. 4 | 370 | 8 |
| Ex. 5 | 290 | 4 |
| Ex. 6 | 330 | 4 |
| Ex. 7 | 510 | 6 |
| Ex. 8 | 410 | 5 |
| Ex. 9 | 330 | 4 |
| Ex. 10 | 330 | 6 |

Effect of Cut-Outs in the Roof and in the Base (Ex.2 and Comp. Ex. A)

As discussed above, Ex. 2 and Comp. Ex. A are identical except that Ex. A has cut-outs in the roof and Ex. 2 has cut-outs in the roof and in the base. A comparison of the E.F. and mixing times are shown below in table 14.

TABLE 14

| | Efficiency Factor (E.F.) | Mixing time(s) |
|---|---|---|
| Ex. 2 | 2.6 | 4 |
| Comp. Ex. A | 3.0 | 7 |

Ex.2 has a smaller E.F. and lower mixing time than Comp. Ex. A indicating that the presence of cut-outs in both the roof and in the base improves vortex formation and also has a beneficial effect on mixing time.

Effect of Extent of Part-Circular Cut-Outs (Prior Art Rotor 1 and Examples 1 to 4)

As discussed previously, examples 1 to 4 are substantially the same except that the extent of cut-outs (indicated by the value for y/(x+y)) decreases in the order Ex. 1, Ex. 2, Ex. 3, Ex.4. A comparison of the E.F. and mixing times for these examples are shown below in table 15.

TABLE 15

| | x (mm) | y (mm) | z (mm) | z/r (%) | y/(x + y) | E.F. | Mixing time (s) |
|---|---|---|---|---|---|---|---|
| Prior art rotor 3 (SPR) | 0 | 0 | 0 | 0 | 0 | n/a vortex inade-quate | 10 |
| Ex. 4 (rotor 80) | 135.27 | 37.52 | 33.76 | 30.7 | 0.217 | 3.4 | 8 |
| Ex. 3 (rotor 70) | 107.50 | 65.28 | 32.77 | 29.8 | 0.378 | 3.2 | 7 |
| Ex. 2 (rotor 60) | 49.92 | 122.87 | 32.45 | 29.5 | 0.711 | 2.6 | 4 |
| Ex. 1 (rotor 40) | 24.96 | 147.83 | 32.45 | 29.5 | 0.856 | 2.5 | 6 |

The E.F. values for examples 1 to 4 decrease as the extent of the cut-out increases. e.g. Ex. 1 has cut-outs which extend for the full distance between adjacent dividers and it has the lowest E.F. value of 2.5. An E.F. was not measured for prior art rotor 3 (SPR) because a sufficient vortex could not be formed.

The presence of cut-outs seems to have a beneficial effect on mixing times because the prior art rotor (with no cut-outs) has the longest mixing time. The relationship between extent of cut-out and mixing time is less clear than with E.F values but the two examples with the greatest extent of cut-out (Ex. 1 and Ex. 2) have lower mixing times than those with a smaller extent of cut-out (Ex. 3 and Ex. 4) so it would seem that a greater extent of cut-out has an overall benefit in the water model.

Effect of Extent of Straight Cut-Outs (Examples 7, 8 and 9)

As discussed previously, examples 7, 8 and 9 are all square-ish rotors having four straight cut-outs. The extent of the cut-outs in examples 7 to 9 increases in the order Ex. 7, Ex. 8, Ex. 9. The E.F. values and mixing times are shown in table 16 below.

TABLE 16

| | x (mm) | y (mm) | z (mm) | z/r (%) | y/(x + y) | E.F. | Mixing time (s) |
|---|---|---|---|---|---|---|---|
| Ex. 7 (rotor 110) | 45.81 | 91.63 | 11.73 | 13.4 | 0.667 | 3.6 | 6 |
| Ex. 8 (rotor 120) | 24.43 | 113.01 | 17.62 | 20.1 | 0.822 | 3.2 | 5 |
| Ex. 9 (rotor 130) | 0 | 137.44 | 25.63 | 29.3 | 1.00 | 2.8 | 4 |

The E.F. values for examples 7 to 9 decrease as the extent of cut-out increases. The mixing times decrease as the extent of cut-out increases with Ex. 9 attaining uniform mixing in just 4 seconds. These results corroborate the results of the comparison for part-circular cut-outs, that an increased extent of cut-out results in improved mixing.

Effect of Depth of Cut-Outs (Examples 2, 6 and 7)

As discussed above, examples 2, 6 and 7, all have cut-outs which have a substantially similar extent (the cut-outs remove similar arcs of a nominal circle C) but the cut-outs each extend a different maximum distance from the peripheral surfaces of the roof and base of the rotor (the depth of the cut-out indicated by the z/r value). The depth of each of the cut-outs in examples 2, 6 and 7 increase in the order Ex. 7, Ex. 2, Ex. 6. E.F. values and mixing times for these rotors are shown in table 17 below.

TABLE 17

| | x (mm) | y (mm) | z (mm) | z/r (%) | y/(x + y) | E.F. | Mixing time (s) |
|---|---|---|---|---|---|---|---|
| Ex. 7 (rotor 110) | 49.92 | 122.87 | 16.81 | 15.3 | 0.711 | 3.6 | 6 |
| Ex. 2 (rotor 60) | 49.92 | 122.87 | 32.45 | 29.5 | 0.711 | 2.6 | 4 |
| Ex. 6 (rotor 100) | 49.92 | 122.87 | 45.52 | 38.65 | 0.711 | 2.2 | 6 |

The E.F. values decrease as the depth of cut-out increases with Ex. 6 having a very low E.F. value of 2.2. The relationship between depth of cut-out and mixing time is less clear with Ex. 2, which has an intermediate depth of cut-out, having the fastest mixing time.

Effect of Chamber and Cross-Sectional Area of Outlets and Inlets (Ex. 2 and Comp. Ex. B)

As discussed above, a new rotor outside of the scope of the invention (Comp. Ex. B was designed in order to investigate the effect of having a chamber and having outlets and inlets where the cross-sectional area of the outlets is greater than that of the respective inlets. Comp. Ex. B is analogous to Ex. 2 having the same size and shape of cut-outs and therefore the same values for x, y and z, as shown in table 18 below for a rotors having a radius of 110 mm.

TABLE 18

| | x (mm) | y (mm) | z (mm) | z/r (%) | y/(x + y) | E.F. | Mixing time (s) |
|---|---|---|---|---|---|---|---|
| Ex. 2 (rotor 60) | 49.92 | 122.87 | 32.45 | 29.5 | 0.711 | 2.6 | 4 |
| Comp. Ex. B (rotor 160) | 49.92 | 122.87 | 32.45 | 29.5 | 0.711 | 2.7 | 5 |

Despite having identical cut-outs, Ex. 2 displays a slight advantage over Comp. Ex. B in terms of vortex formation and mixing time. Taken in combination with improved degassing associated with Ex. 2, this indicates that presence of a chamber and outlets that have a greater cross-sectional area than the respective inlets, provides an improved rotor for use in metal treatment.

Effect of Chamber and Outlets (Prior Art Rotor 4 and Ex. 9)

As discussed above the prior art rotor 4 ("Brick") has no inlets, outlets or a chamber but can be viewed as having four straight cut-outs like Ex. 9. The x, y and z values for prior art rotor 4 and Ex. 9 are identical and shown in table 19 below for a rotor having a radius of 110 mm.

TABLE 19

| | x (mm) | y (mm) | z (mm) | z/r (%) | y/(x + y) | E.F. | Mixing time (s) |
|---|---|---|---|---|---|---|---|
| Prior art rotor 4 ("Brick") | 0 | 172.79 | 32.22 | 29.3 | 1.000 | 3.0 | 7 |
| Ex. 9 (rotor 130) | 0 | 172.79 | 32.22 | 29.3 | 1.000 | 2.8 | 4 |

The "Brick" rotor has a larger E.F. and a longer mixing time than the rotor of the invention indicating that the presence of inlets, outlets, and a chamber is beneficial for the mixing of treatment agents.

All of the rotors of the invention have uniform mixing times that are equal to or less that those of prior art rotors XSR, Diaman™ and SPR (8s, 12s and 10s).

CONCLUSIONS

The above data demonstrates that the rotors of the present invention provide advantages in terms of mixing efficiency in metal treatment and degassing.

The invention claimed is:

1. A rotary device for treating molten metal, said device comprising a hollow shaft at one end of which is a rotor, said rotor having:— a roof and a base, said roof and base being spaced apart and connected by a plurality of dividers;

a passage being defined between each adjacent pair of dividers and the roof and the base, each passage having an inlet in an inner surface of the rotor and an outlet in a peripheral surface of the rotor, each outlet having a greater cross-sectional area than the respective inlet and being disposed radially outward therefrom;

a flow path being defined through the shaft into the inlets of the passages and out of the outlets; and a chamber in which mixing of the molten metal and gas can take place wherein the chamber is located radially inwardly of the inlets and has an opening in the base of the rotor and is in the flowpath between the shaft and the inlets, such that in use when the device rotates, molten metal is drawn into the chamber through the base of the rotor where it is mixed with gas passing into the chamber from the shaft, the metal/gas dispersion then being pumped into the passages through the inlets before being discharged from the rotor through the outlets;

wherein a plurality of first cut-outs are provided in the roof and a plurality of second cut outs are provided in the base, each of the first and second cut outs being contiguous with one of the passages.

2. A rotary device as claimed in claim 1, wherein each first cut-out extends inwardly from the outer peripheral surface of the rotor and is contiguous with an outlet.

3. A rotary device as claimed in claim 2, wherein the extent of each first cut-out in the peripheral surface is no more than that of the corresponding outlet.

4. A rotary device as claimed in claim 1, wherein each first cut-out is part-circular and the first cut-outs are arranged symmetrically around the rotor.

5. A rotary device as claimed in claim 1, wherein the second cut-outs have the same size and shape as the first cut-outs.

6. A rotary device as claimed in claim 1, wherein the number of first cut-outs is equal to the number of second cut-outs.

7. A rotary device as claimed in claim 1, wherein the rotor has three, four or five passages.

8. A rotary device as claimed in claim 7, wherein the rotor has four passages.

9. A rotary device as claimed in claim 1, wherein the rotor has exactly one outlet and exactly one each of the first and second cut-outs per passage.

10. A rotary device as claimed in claim 1, wherein the rotor has exactly one outlet, and exactly two first cut-outs and two second cut-outs per passage.

11. A rotary device as claimed in claim 6, wherein each first cut-out in a passage is in full register with the corresponding second cut-out.

12. A rotary device as claimed in claim 1, wherein the first and/or second cut-outs extend inwardly no further than 50% of the radius of the rotor.

13. A rotary device as claimed in claim 1, wherein the first and/or second cut-outs extend inwardly no less than 10% of the radius of the rotor.

14. A rotary device as claimed in claim 1, wherein the peripheral surface of the rotor in a plane orthogonal to the shaft axis is nominally a circle, and the ratio of the length of the arc of the circle circumference removed in the roof by the first cut-out or cut-outs or removed in the base by the second cut-out or cut-outs contiguous with a given passage multiplied by the number of passages, to the circumference of the circle is at least 0.3.

15. A rotary device as claimed in claim 14, wherein the ratio is no more than 0.9.

16. A rotary device as claimed in claim 1, wherein the shaft and rotor are formed separately, the two being attached together by releasable fixing means.

17. A rotor for use in the rotary device of claim 1, said rotor having a roof and a base, said roof and base being spaced apart and connected by a plurality of dividers;

a passage being defined between each adjacent pair of dividers and the roof and the base, each passage having an inlet in an inner surface of the rotor and an outlet in a peripheral surface of the rotor, each outlet having a greater cross-sectional area than the respective inlet and being disposed radially outward therefrom;

a flow path being defined through the inlets of the passages and out of the outlets; and a chamber in which mixing of the molten metal and gas can take place wherein the chamber is located radially inwardly of the inlets and has an opening in the base of the rotor and is in the flowpath between the shaft and the inlets, such that in use when the device rotates, molten metal is drawn into the chamber through the base of the rotor where it is mixed with gas passing into the chamber from the shaft, the metal/gas dispersion then being pumped into the passages through the inlets before being discharged from the rotor through the outlets;

wherein a plurality of first cut-outs are provided in the roof and a plurality of second cut outs are provided in the base, each of the first and second cut outs being contiguous with one of the passages.

18. A metal treatment unit for degassing and/or for addition of metal treatment substances comprising the rotary device of claim 1.

19. A method of treating molten metal comprising the steps of:—

(i) immersing the rotor and part of the shaft of the rotary device of claim 1 in the molten metal to be treated, (ii) rotating the shaft, and (iii) passing gas and/or one or more treatment substances down the shaft and into the molten metal via the rotor and/or passing one or more treatment substances directly into the molten metal, whereby to treat the metal.

20. The method of claim 19, wherein the metal being treated is selected from aluminium and its alloys, magnesium and its alloys and copper and its alloys.

21. The method of claim 19, wherein the gas passed in step (iii) is a dry inert gas.

22. A rotary device as claimed in claim 12, wherein the first and/or second cut-outs extend inwardly no further than 40% of the radius of the rotor.

23. A rotary device as claimed in claim 13, wherein the first and/or second cut-outs extend inwardly no less than 20% of the radius of the rotor.

24. A rotary device as claimed in claim 14, wherein the ratio is at least 0.6.

* * * * *